US011317691B2

(12) United States Patent
Provost et al.

(10) Patent No.: US 11,317,691 B2
(45) Date of Patent: May 3, 2022

(54) SHAVING ASSEMBLY DISPENSER

(71) Applicant: ShaveLogic, Inc., Dallas, TX (US)

(72) Inventors: Craig A. Provost, Newport Beach, CA (US); John W. Griffin, Moultonboro, NH (US); William E. Tucker, Plymouth, MA (US); Aaron G. Cantrell, Northampton, MA (US)

(73) Assignee: SL IP COMPANY LLC, Dallas, TX (US)

( * ) Notice: Subject to any disclaimer, the term of this patent is extended or adjusted under 35 U.S.C. 154(b) by 167 days.

(21) Appl. No.: 16/696,176

(22) Filed: Nov. 26, 2019

(65) Prior Publication Data

US 2020/0093241 A1 Mar. 26, 2020

Related U.S. Application Data

(60) Division of application No. 15/405,215, filed on Jan. 12, 2017, now Pat. No. 10,506,860, which is a continuation of application No. PCT/US2015/039278, filed on Jul. 7, 2015.

(Continued)

(51) Int. Cl.

| | |
|---|---|
| ***B65D 6/06*** | (2006.01) |
| ***B65D 25/04*** | (2006.01) |
| ***A45D 27/22*** | (2006.01) |
| ***B65D 43/12*** | (2006.01) |
| ***B65D 43/20*** | (2006.01) |

(Continued)

(52) U.S. Cl.

CPC ..... *A45D 27/225* (2013.01); *B26B 21/24* (2013.01); *B26B 21/40* (2013.01); *B65D 11/12* (2013.01); *B65D 25/04* (2013.01); *B65D 43/12* (2013.01); *B65D 43/20* (2013.01); *B26B 21/521* (2013.01); *B65D 5/38* (2013.01); *B65D 7/10* (2013.01); *B65D 9/08* (2013.01); *B65D 2501/24019* (2013.01); *B65D 2543/0025* (2013.01);

(Continued)

(58) Field of Classification Search

CPC ..... B65D 83/10; A45D 27/24; A45D 27/225

See application file for complete search history.

(56) References Cited

U.S. PATENT DOCUMENTS

| | | | |
|---|---|---|---|
| 3,033,355 | A | 5/1962 | Van Sickle |
| 4,007,828 | A | 2/1977 | Mayled |

(Continued)

FOREIGN PATENT DOCUMENTS

| | | | |
|---|---|---|---|
| GB | 2042476 | A | 9/1980 |
| JP | 2006075188 | A | 3/2006 |

(Continued)

OTHER PUBLICATIONS

Search Report/Written Opinion—Corresponding PCT Application No. PCT/US15/39278, dated Dec. 7, 2015, 12 pages.

*Primary Examiner* — Mollie Impink

(74) *Attorney, Agent, or Firm* — Leber IP Law; Celia H. Leber

(57) ABSTRACT

Containers are described herein for the transportation and distribution of replaceable consumer products, e.g. interchangeable shaving assemblies. The containers described herein include a mechanism to securely hold the container in predetermined open and closed positions. The interior of the container may provided features which serve to hold and protect the shaving assemblies when not in use, e.g., during transport or storage.

8 Claims, 23 Drawing Sheets

Related U.S. Application Data

(60) Provisional application No. 62/027,120, filed on Jul. 21, 2014.

(51) Int. Cl.

| | |
|---|---|
| ***B26B 21/40*** | (2006.01) |
| ***B26B 21/24*** | (2006.01) |
| *B65D 5/38* | (2006.01) |
| *B26B 21/52* | (2006.01) |

(52) U.S. Cl.
CPC ..... *B65D 2543/00296* (2013.01); *B65D 2583/0454* (2013.01)

(56) References Cited

U.S. PATENT DOCUMENTS

| | | | |
|---|---|---|---|
| 4,170,821 | A | 10/1979 | Booth |
| 4,173,285 | A | 11/1979 | Kiraly et al. |
| 4,284,204 | A | 8/1981 | Carey, Jr. |
| 4,333,567 | A | 6/1982 | Leonard |
| 4,831,729 | A | 5/1989 | Beuchat |
| 4,898,195 | A | 2/1990 | Sussman |
| 5,080,222 | A | 1/1992 | McNary |
| 5,160,026 | A | 11/1992 | Marsh |
| 5,275,291 | A | 1/1994 | Sledge |
| 5,285,897 | A | 2/1994 | Ozaki |
| 2004/0055903 | A1 | 3/2004 | Nishimura |
| 2004/0069666 | A1 | 4/2004 | Zieger |
| 2009/0056151 | A1 | 3/2009 | Kohring et al. |
| 2009/0152134 | A1 | 6/2009 | Katsis |
| 2010/0133140 | A1 | 6/2010 | Bailey |

FOREIGN PATENT DOCUMENTS

| | | | |
|---|---|---|---|
| KR | 870000962 | Y1 * | 3/1987 |
| KR | 870000962 | Y1 | 3/1987 |

* cited by examiner

SHAVING ASSEMBLY DISPENSER

RELATED APPLICATIONS

This application is a divisional application of U.S. patent application Ser. No. 15/405,215, filed Jan. 12, 2017, which is a continuation of PCT Application Serial No. PCT/US15/39278, filed Jul. 7, 2015, which claims priority to U.S. Provisional Application Ser. No. 62/027,120, filed Jul. 21, 2014, the entire contents of which are hereby incorporated by reference.

BACKGROUND

Some consumer shaving systems utilize detachable shaving assemblies that are adapted for use with a handle. The shaving assemblies can utilize a plurality of blades that dull from repeated use necessitating their eventual replacement. Replacement shaving assemblies can be purchased independently from the complete shaving system. Such replacement shaving assemblies are frequently packaged in a magazine configuration, i.e., is a container that serves to orient the shaving assembly to allow for proper engagement with the handle. The container protects the blades during transit and storage from damage by elevating the shaving assembly from the base of the container and holding the shaving assemblies removably in place in the container.

A shaving assembly dispenser that includes an outer container and an inner container slidably disposed within the outer container is disclosed in U.S. patent application Ser. No. 14/101,163, the full disclosure of which is incorporated herein. The preferred dispensers disclosed therein include cooperating features configured to releasably retain the inner container in various positions relative to the outer container, for example stop tabs extending from the bottom of the inner container that are received in corresponding openings in the bottom of the outer container.

SUMMARY

In general, the invention features containers for consumer products, e.g. replaceable shaving assemblies. The containers are configured to hold multiple replaceable shaving assemblies and individually dispense them. Like the dispensers disclosed in U.S. patent application Ser. No. 14/101,163, the containers include an outer container and an inner container slidably disposed within the outer container. However, in the present disclosure the outer container is generally C-shaped, and wraps around rather than fully enclosing the inner container. In preferred implementations, the dispensers include cooperating features on the outer and inner containers that are configured to releasably retain the inner container in various positions relative to the outer container.

In one aspect the invention features a device comprising an outer container, and a sectioned inner container defining at least two compartments, each compartment being dimensioned to hold a shaving assembly. The outer container is generally C-shaped, such that it includes an open area where a bottom surface of the inner container is exposed. The inner container is disposed within the outer container and is movable relative to the outer container between a closed position, a first open position in which one of the shaving assemblies is exposed, and a second open position in which the other shaving assembly is exposed.

Some implementations include one or more of the following features.

The outer container may include a top wall, opposing side walls, and bottom portions extending inwardly from the side walls to opposing terminal edges. The inner container may include guide rails, extending downwardly from the bottom surface of the inner container, disposed parallel to the terminal edges and positioned for sliding face-to-face engagement with the terminal edges.

The device may include an outer container and inner container which include cooperating features configured to releasably retain the inner container in each of its positions relative to the outer container. In some cases, the cooperating features are oriented for face-to-face engagement in a plane that is generally parallel to the bottom surface of the inner container. In some embodiments, the retaining features on the outer container are disposed along edges of the outer container that define the open area, and the corresponding retaining features on the inner container are disposed on the guide rails. The retaining features on the inner container may be, for example, tabs that extend generally perpendicular away from the bottom surface of the inner container and along the bottom surface toward the recesses in the outer container. The tabs may have features which correspond to complementary shaped recesses on the adjacent edge of the outer container.

In some implementations, each compartment of the inner container may include positioning features, e.g., angled features, configured to position the shaving assembly within the compartment. The angled features may include support members configured to support blades of the shaving assembly above a floor surface of the compartment. The angled features may be configured to position the shaving assembly favorably for interaction with a razor handle during mounting of the shaving assembly on the handle.

In some implementations, the outer container may be configured with open ends. The inner container may be open on the top. The inner container may include an opening configured to allow drainage from the inner container. The outer container may be configured to allow controlled movement of the inner container.

In some implementations of the device the outer container may include lead-in features that are positioned to facilitate movement of the retaining features when the inner container is moved between its first or second positions and its closed position, or during the assembly of the inner container into the outer container.

The invention also features methods of using the devices described herein. For example, in one aspect the invention features a method that includes (a) providing a device for storing shaving assemblies, the device including a generally C-shaped outer container, and a sectioned inner container defining at least two compartments, each compartment being dimensioned to hold a shaving assembly, the inner container being disposed within the outer container and being movable relative to the outer container between a closed position, a first open position in which one of the shaving assemblies is exposed, and a second open position in which the other shaving assembly is exposed; (b) moving the inner container from its closed position into its first or second position; and (c) mounting the exposed shaving assembly on a razor handle.

The method may further include inserting a used shaving assembly into one of the compartments and moving the inner container to the closed position.

In another aspect, the invention features a shaving system comprising a generally C-shaped outer container, a sectioned inner container defining at least two compartments, and a shaving assembly in each compartment, the inner container being disposed within the outer container and being movable relative to the outer container between a closed position, a first open position in which one of the shaving assemblies is exposed, and a second open position in which the other shaving assembly is exposed.

In some implementations, the shaving assemblies are free-floating within the compartments of the inner container, and the shaving assemblies are positioned in the compartments facing in opposite directions.

DETAILED DESCRIPTION

The present disclosure relates generally to consumer products and, in particular, to shaving systems with interchangeable shaving assemblies. In one embodiment, the present disclosure features a reusable consumer product system having a container that securely holds interchangeable shaving assemblies. The container is designed to protect the shaving assemblies during transit, e.g., to the point of use, and storage, and to allow safe storage and disposal of used cartridges.

Figure 1:
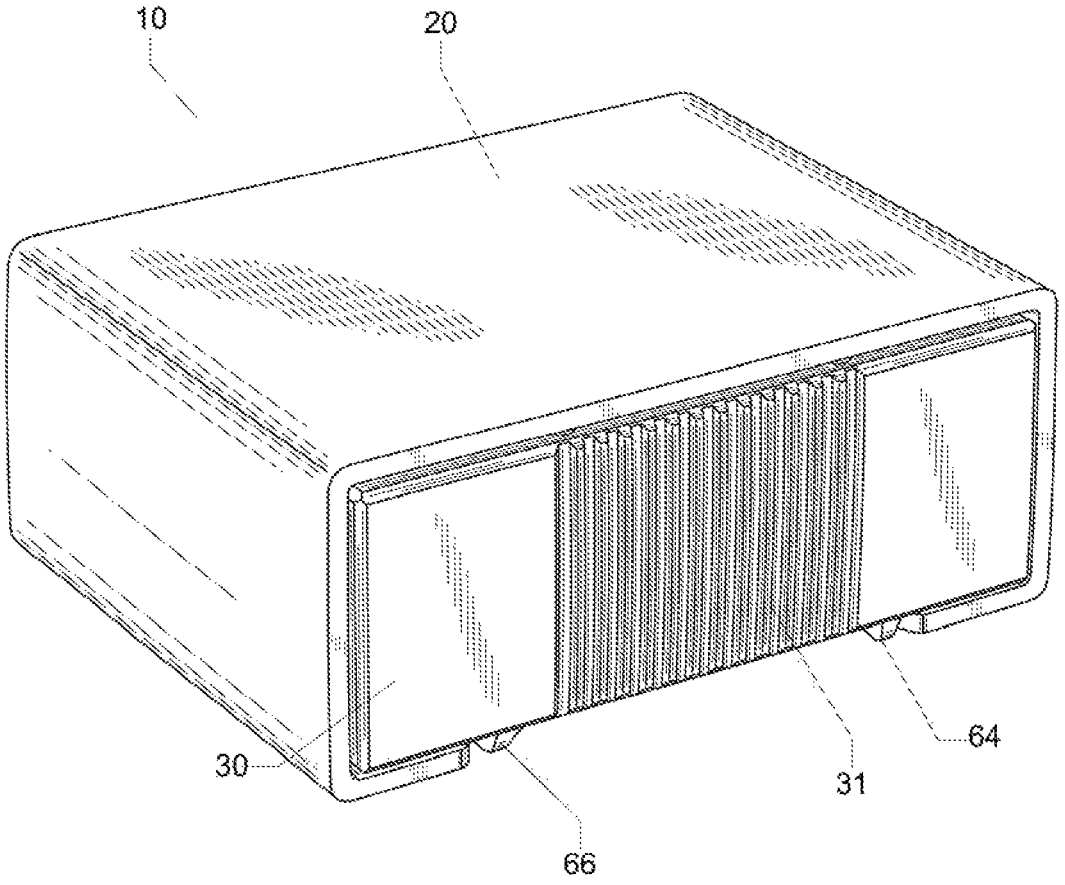
FIG. 1 is a perspective view of the device in the closed position.
Figure 2:
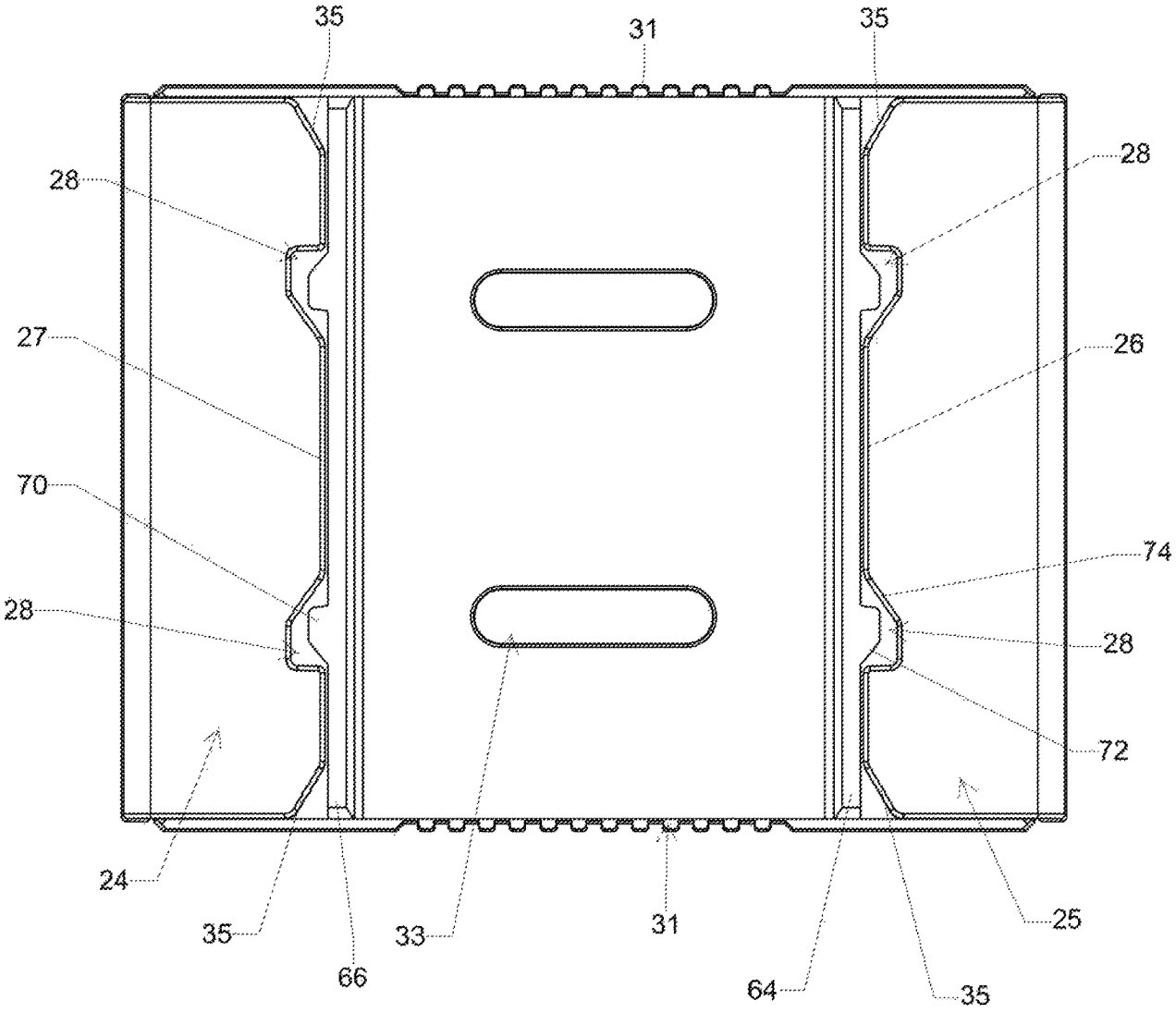
FIG. 2 is a bottom, planar view of the device in the closed position.
Figure 2A:
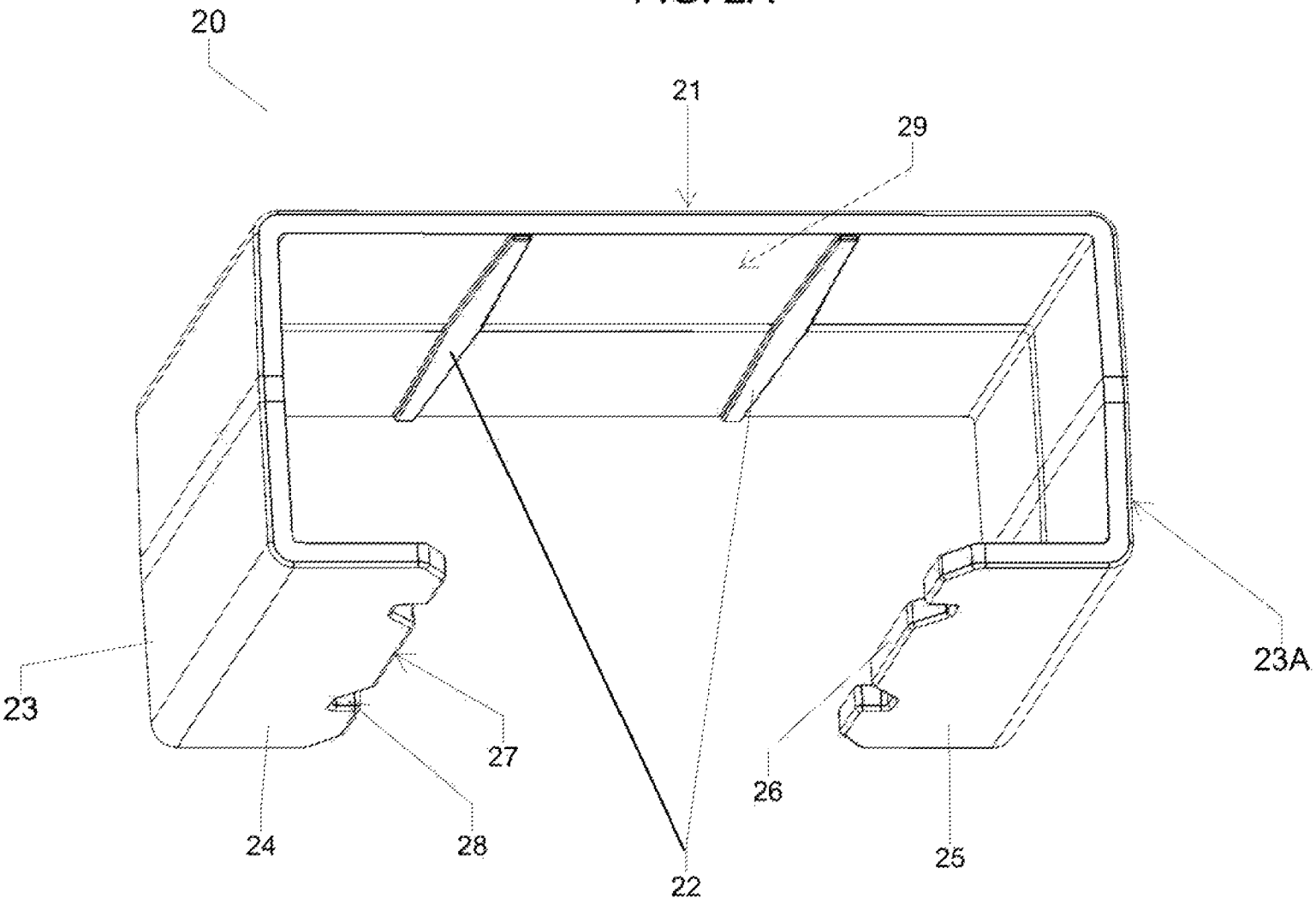
FIG. 2A is a perspective view of the outer portion of the device.

Referring to FIGS. 1, 2 and 2A, a container 10 includes a generally C-shaped outer portion 20 and an inner portion 30. By "generally C-shaped," we mean that the outer portion wraps around the inner portion and includes an open area rather than completely surrounding the inner portion. In the embodiment shown in FIGS. 1, 2 and 2A, the outer portion 20 has an upper wall 21, opposing side walls 23 and 23A, and bottom walls 24 and 25 extending inward from the side walls to opposing terminal edges 26 and 27. The outer portion 20 may be formed with the side walls 23, 23A that are generally perpendicular to a substantially planar upper wall, or may have other initial shapes, so long as the outer portion and inner portion interact generally as discussed below.

Figure 18:
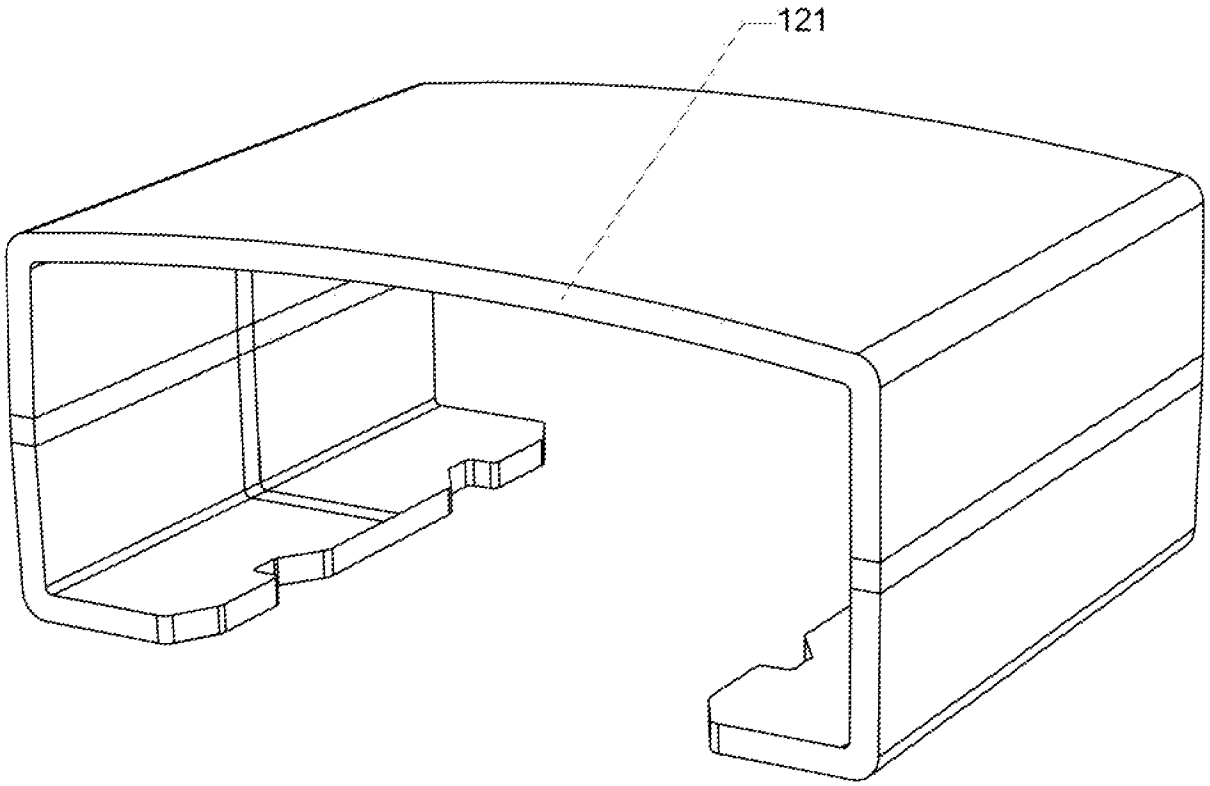
FIG. 18 is a perspective view of the outer portion of the device according to one embodiment.

For example, the outer portion may be formed with a bowed upper wall 121 (e.g., as shown in FIG. 18) which is flattened out by outward deflection of the side walls during insertion of the inner portion into the outer portion. To produce this outward deflection and flattening, the side walls bend inward slightly rather than being substantially vertical. In some implementations, in addition to or instead of the bowing of the upper wall, the bottom walls may bend up slightly toward the upper wall such that they deflect downward during insertion of the inner portion into the outer portion. The flattening out of the bowed upper wall and outward deflection of the side walls, and/or the downward deflection of the bottom walls, creates a pretensioning of the outer portion against the inner portion, as will be discussed further below.

Referring to FIG. 2A, a plurality of open areas 28 are defined between the edges 26 and 27. The inner portion 30 is configured to be received within the outer portion 20, with the side walls 23, 23A and bottom walls 24, 25 wrapping around the inner portion 30. The central area of the bottom surface of the inner portion 30 is exposed by the open area 28 of the outer portion 20.

There are many inherent benefits to the generally C-shape of the outer portion 20 as compared to an outer portion that completely surrounds the inner portion. For instance, the outer portion can be easily manufactured, and requires less raw material. Moreover, less stringent dimensional tolerances are required between the inner and outer portions, due to the flexible nature of the outer portion. In addition, drainage from the inner portion to the exterior of the container is improved, preventing damage to razor cartridges stored in the container and helping to keep the inner portion cleaner.

Referring to FIGS. 2 and 2A, guide rails 64, 66 extend downwardly from the bottom surface of the inner portion 30, and are positioned for sliding engagement with edges 26, 27 of the outer portion 20, to guide relative movement of the inner and outer portions. The pretensioning between the outer and inner portions, discussed above, may be employed to improve the controlled sliding engagement of the two portions.

Referring to FIGS. 2 and 2A, a tactile element 31, e.g., in the form of alternating raised and recessed ridges, is configured in the center of the inner portion 30. An additional tactile element is configured on the opposite end of the inner portion 20. The outer portion 20 features four lead-in features 35 each that have an angled shape. The function of these lead-in features will be discussed in detail at a later point.

Figure 5:
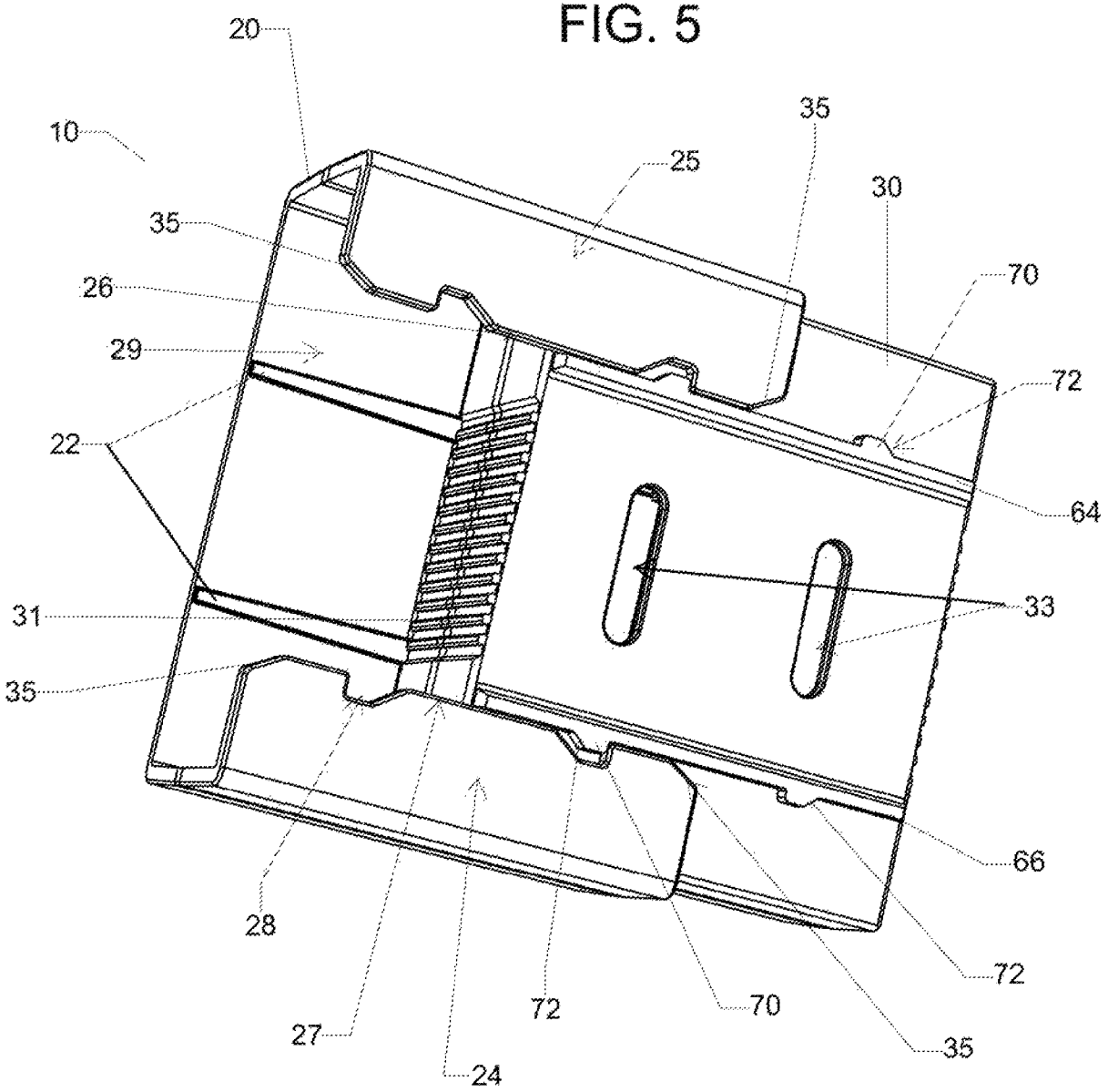
FIG. 5 is a perspective view of the bottom of the device in a first open position.

Referring to FIGS. 2 and 5, the edges 26 and 27 of the outer portion include retaining features that engage corresponding features extending from the bottom surface of the inner portion to releasably retain the inner container in various positions relative to the outer container. In the embodiment shown in FIG. 2A, the inner portion includes stop tabs 70 and the outer portion includes corresponding recesses 28 in its edges 26 and 27. Stop tabs 70 protrude outwardly from guide rails 64, 66. Recesses 28 are positioned for face-to-face engagement with the corresponding stop tabs 70 when the inner portion is in various predetermined positions with respect to the outer portion. If the outer portion has an initially bowed upper wall and/or angled bottom walls, as discussed above, the pretensioning applied to the bottom walls urges the stop tabs 70 toward the recesses 28, facilitating engagement of the stop tabs in the recesses. The interaction between these retaining features will be discussed in further detail below.

Figure 3:
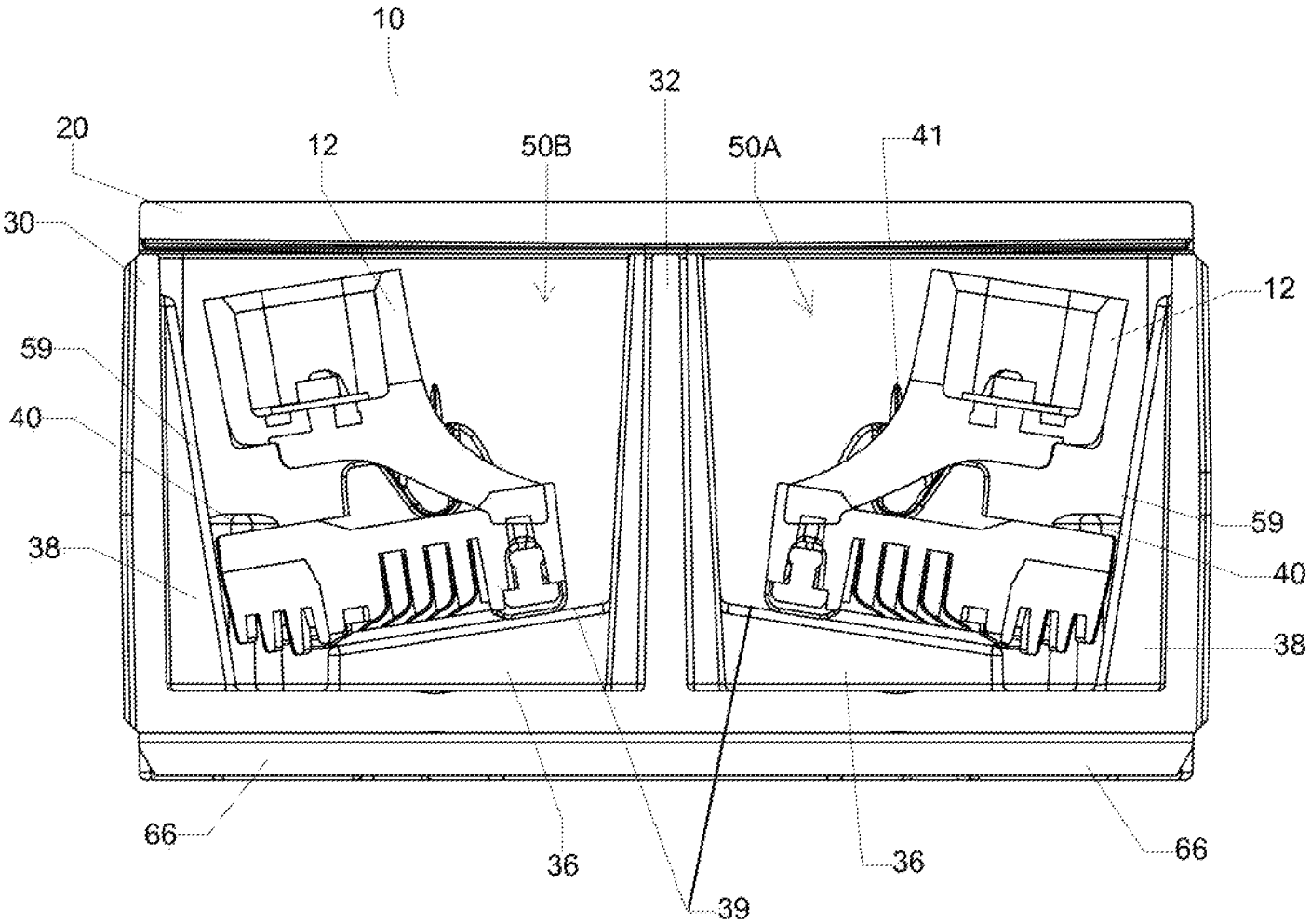
FIG. 3 is a sectional, planar view of the device loaded with two shaving cartridges.
Figure 8:
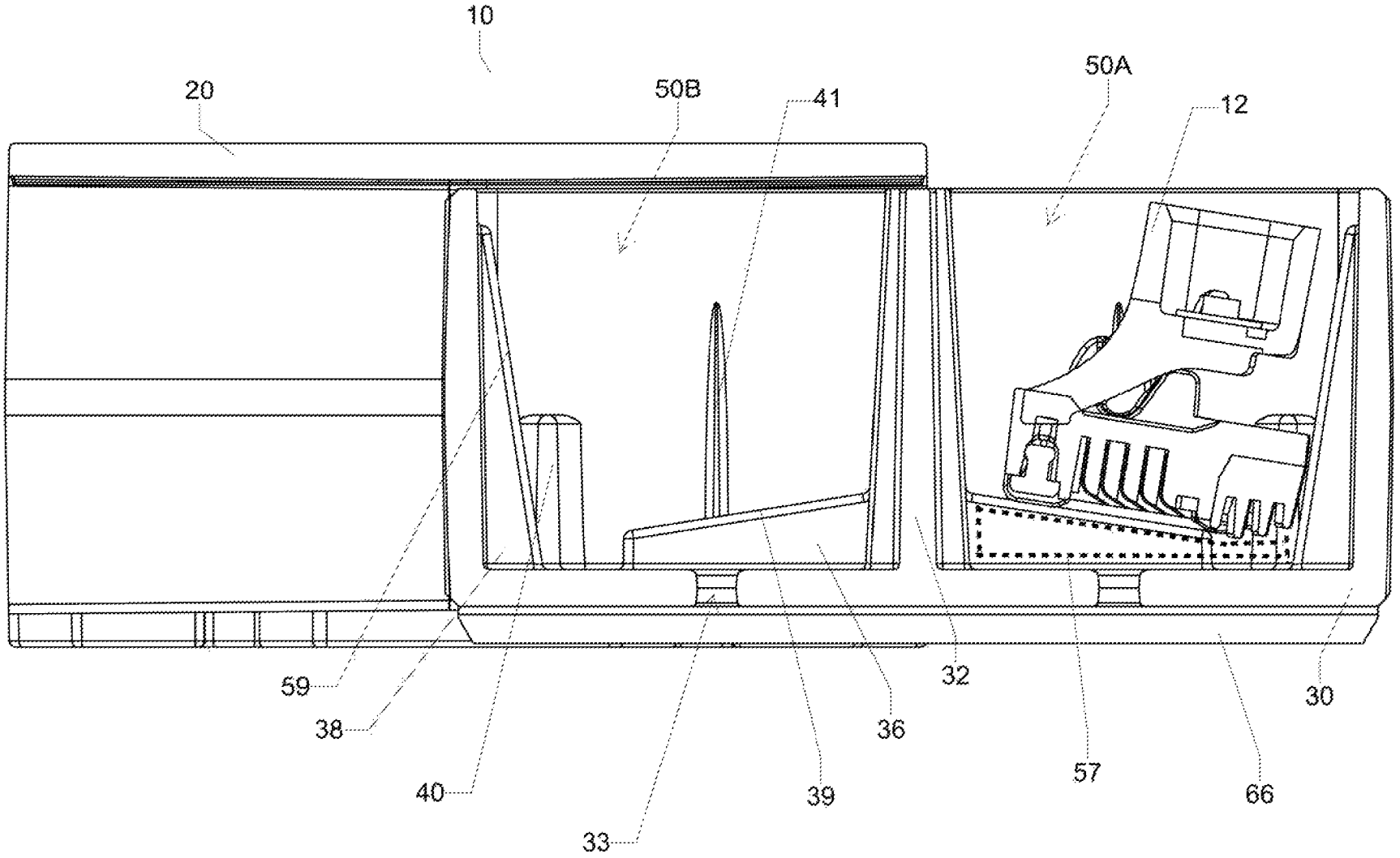
FIG. 8 is a planar, sectional view of the device in a first open position loaded with a shaving cartridge.
Figure 9:
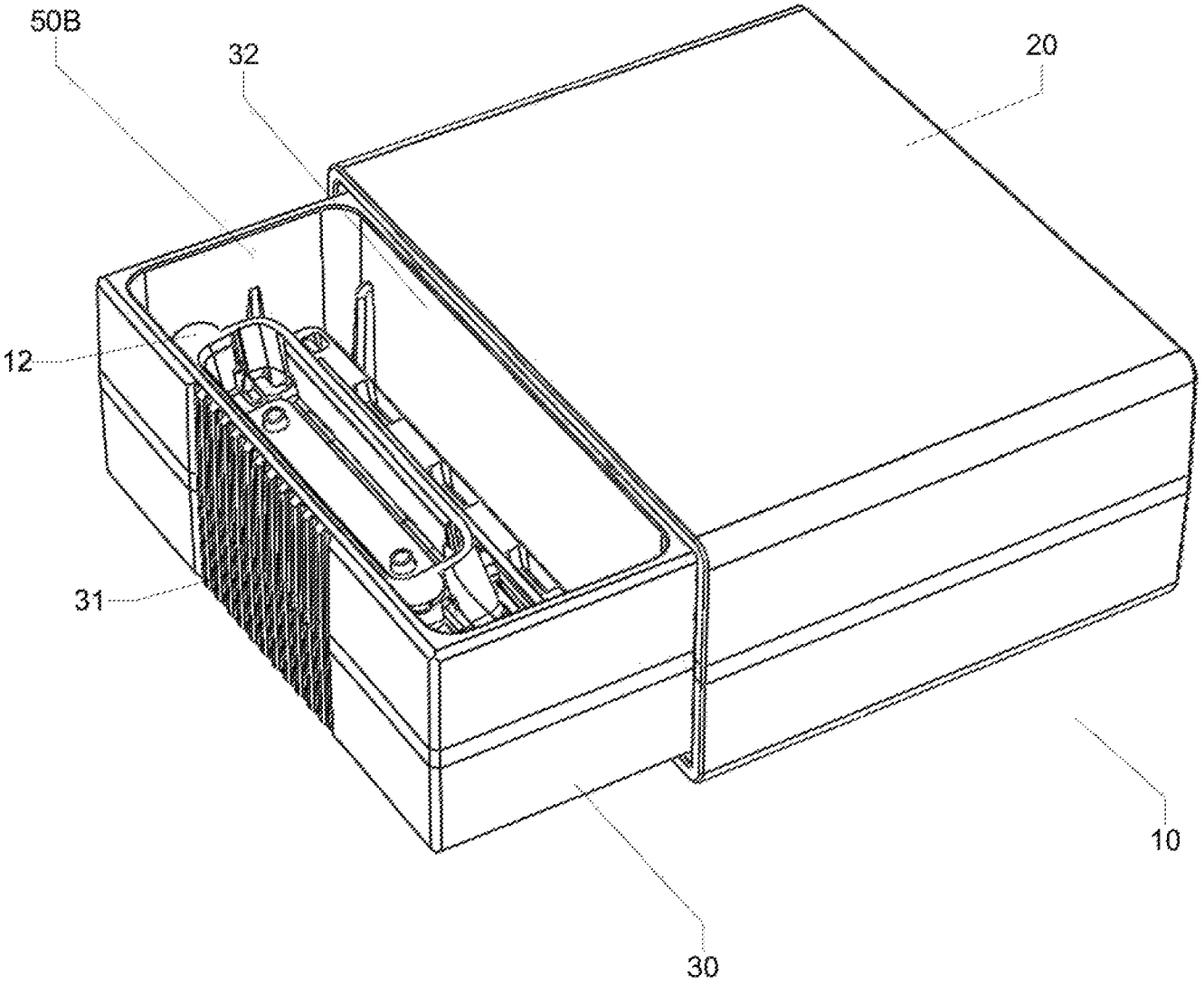
FIG. 9 is a perspective view of the device in a second open position loaded with a shaving cartridge.
Figure 11:
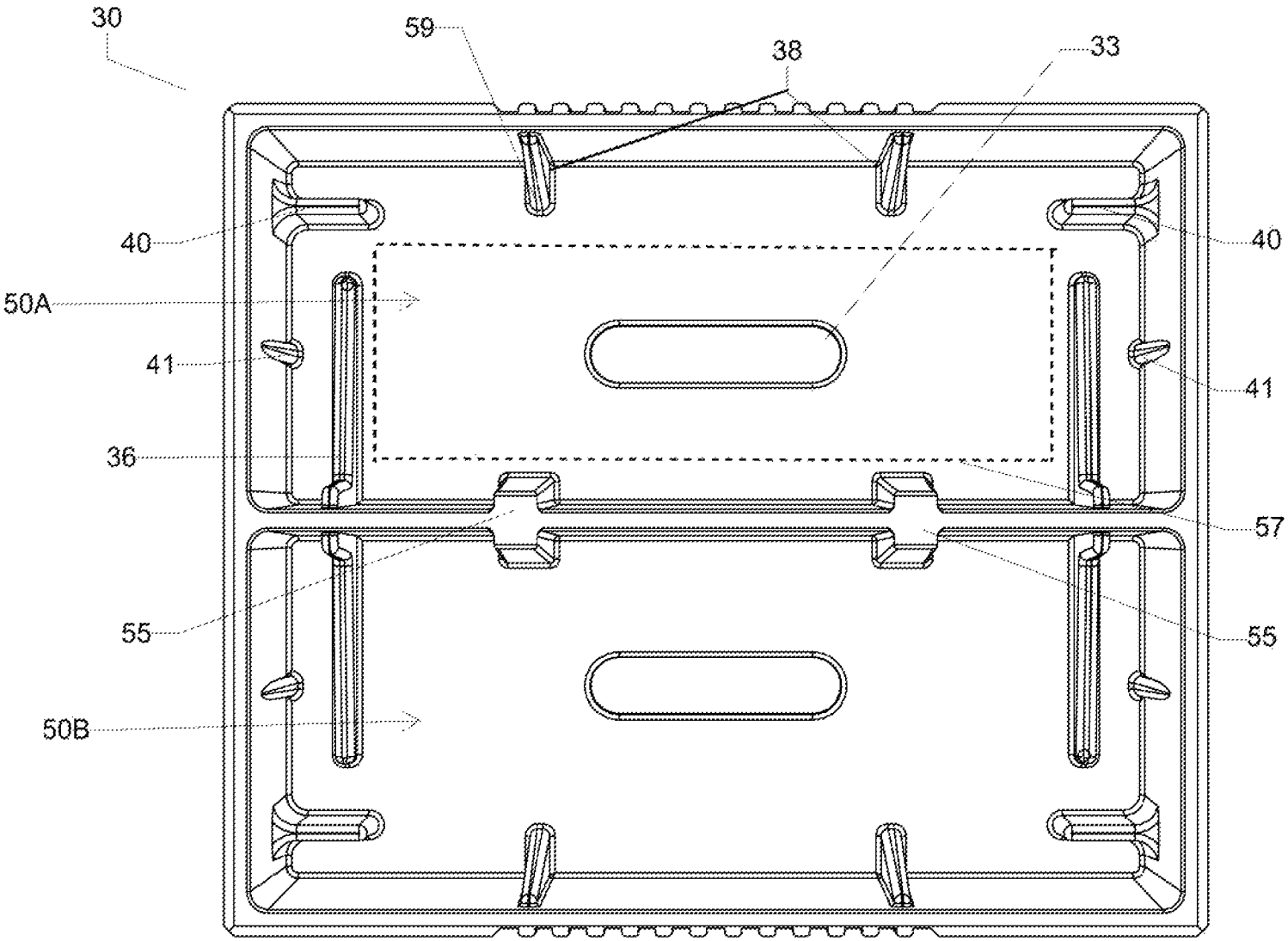
FIG. 11 is a top, planar view of the inner portion.
Figure 12:
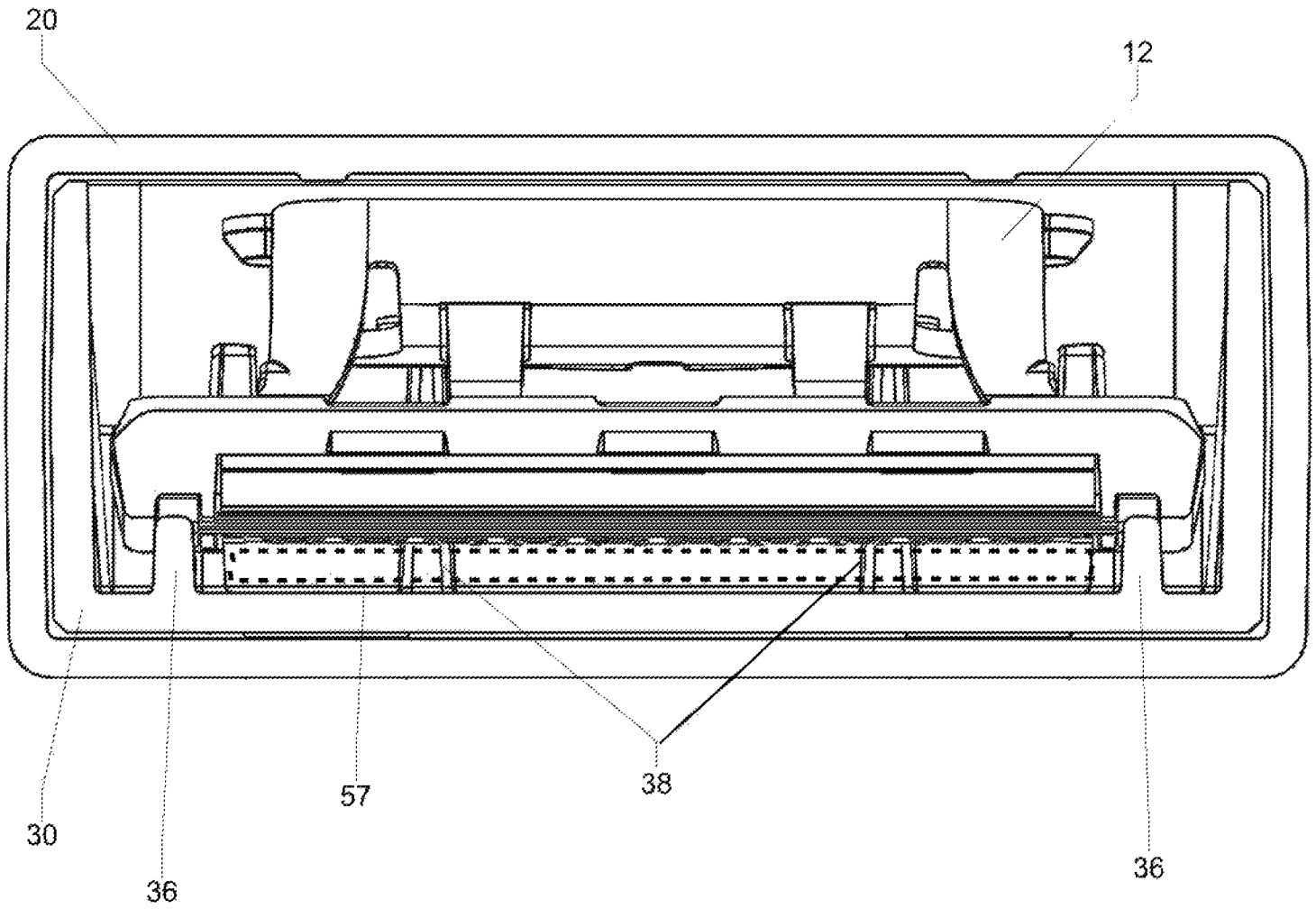
FIG. 12 is a sectional view of the device loaded with a shaving cartridge.
Figure 14:
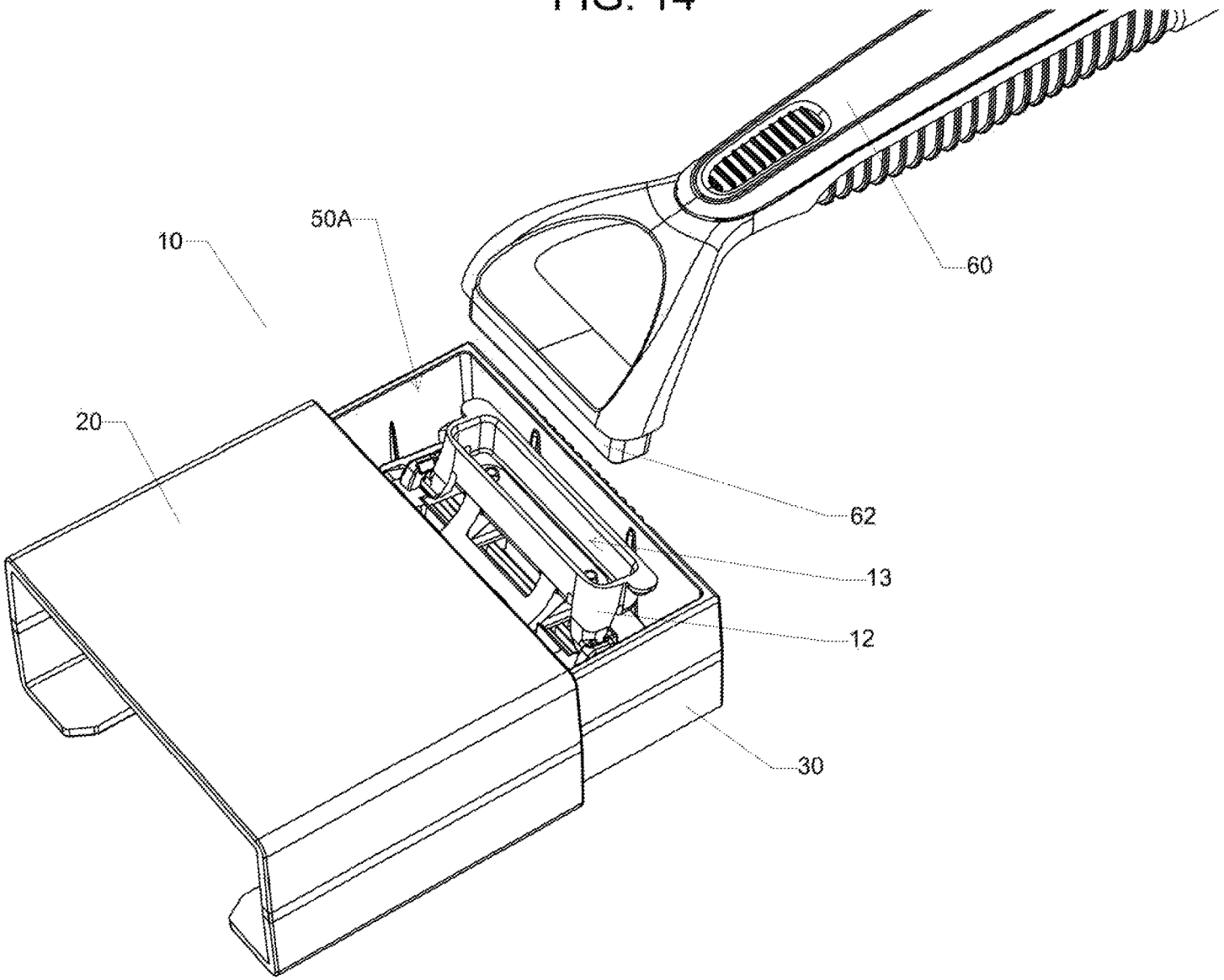
FIG. 14 is a top, perspective view of device with a handle separated from a shaving cartridge.

Referring to FIGS. 3 and 11, the inner portion 20 is divided into two equal sections by divider 32, creating two distinct cavities 50A, 50B (FIG. 11). The cavities 50A and 50B are mirror opposites of each other. The cavities 50A and 50B are each dimensioned to receive and hold a shaving assembly 12. Each cavity has raised features 36, 38, 40 that orient the shaving assembly 12 in a predetermined position to allow for ease of alignment with handle (60) (FIG. 14). As shown, the shaving assemblies 12 are positioned facing opposite directions in inner portion 30. There are two raised features 36 on the floor of the cavity 50B that are positioned so as to be outboard of the blades of the blade unit and provide an open area 57 under the blades (FIGS. 8, 11, 12). Each of the raised features 36 has an angled surface 39 that positions the shaving assembly 12 at generally a 10° angle with respect to the plane of the floor. There are two raised features 38 on the back wall of the cavity 50B that taper as they extend vertically. Each of the two raised features 38 has an angled surface 59 that positions the shaving assembly 12 at an angle with respect to the plane of the back wall. The angled surfaces 39 of raised features 36 are perpendicular to the angled surfaces 59 of raised features 38.

Figure 14A:
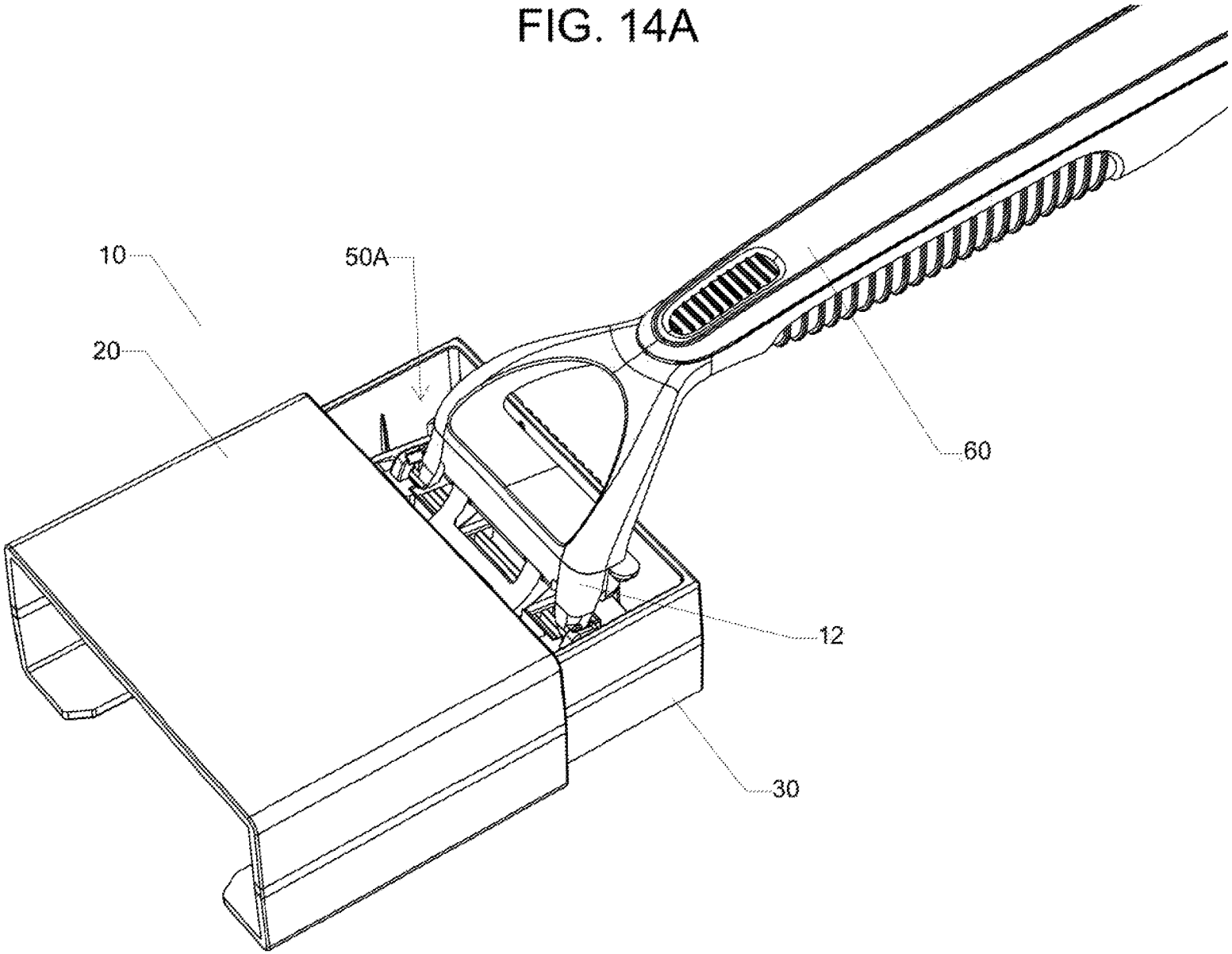
FIG. 14A is a top, perspective view of the device with a handle engaging the shaving cartridge.

As a result, the opening of the interface element 13 is positioned so that the appendage on the handle 62 (FIG. 14) can be easily inserted into the opening of the interface element when the long axis of the handle is generally parallel to the top surface (e.g. within plus or minus 10°) of the outer portion 20 (FIG. 14A). This positioning is particularly advantageous when the shaving assembly 12 is attached to the handle by a magnetic force, e.g. as described in U.S. application Ser. No. 13/802,546 filed on Mar. 13, 2013, the full disclosure of which is incorporated by reference herein.

Figure 10:
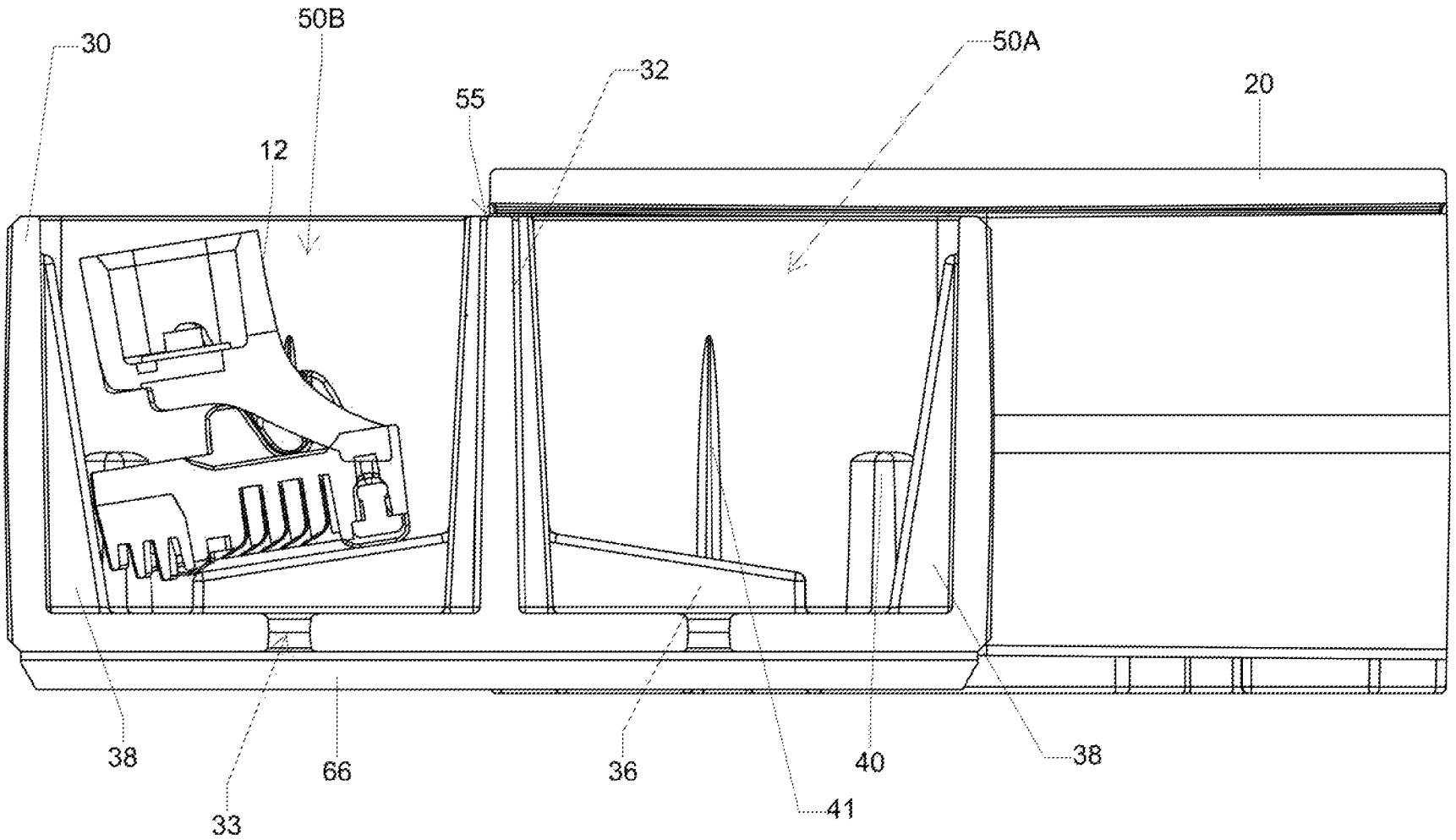
FIG. 10 is a sectional, planar view of the device loaded with a shaving cartridge in the second open position.

Referring to FIGS. 8, 10, and 11, each cavity 50A, 50B also includes two stop features 40 positioned to limit horizontal movement of the shaving assembly 12. These features are included because the shaving assembly 12 is free floating within the cavities 50A, 50B. The lack of any retaining features within the cavity facilitates the use of magnetic force to attach the shaving assembly to the handle.

Figure 13:
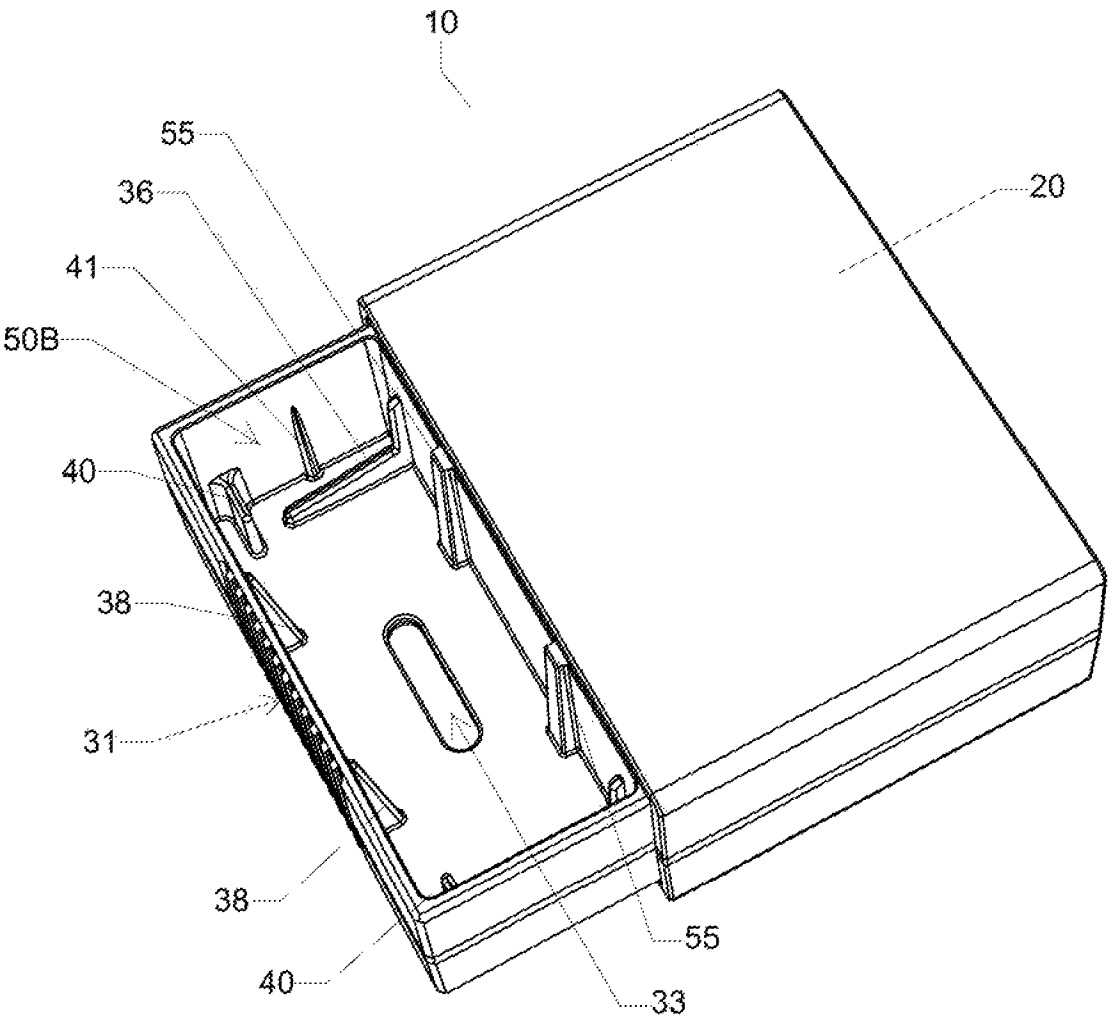
FIG. 13 is a top, perspective view of the device in the second open position.

Referring to FIGS. 11 and 13, each cavity also includes two raised features 41 that extend into the cavity from the sidewalls. Raised features 41 eliminate lateral movement of the shaving assembly 12 within the cavity during shipment or storage. Stop features 40 and raised features 41 together maintain the shaving assembly 12 in a substantially stable position within the cavity, e.g., during transport, reducing the likelihood of damage to the shaving assembly due to excessive movement.

Figure 16:
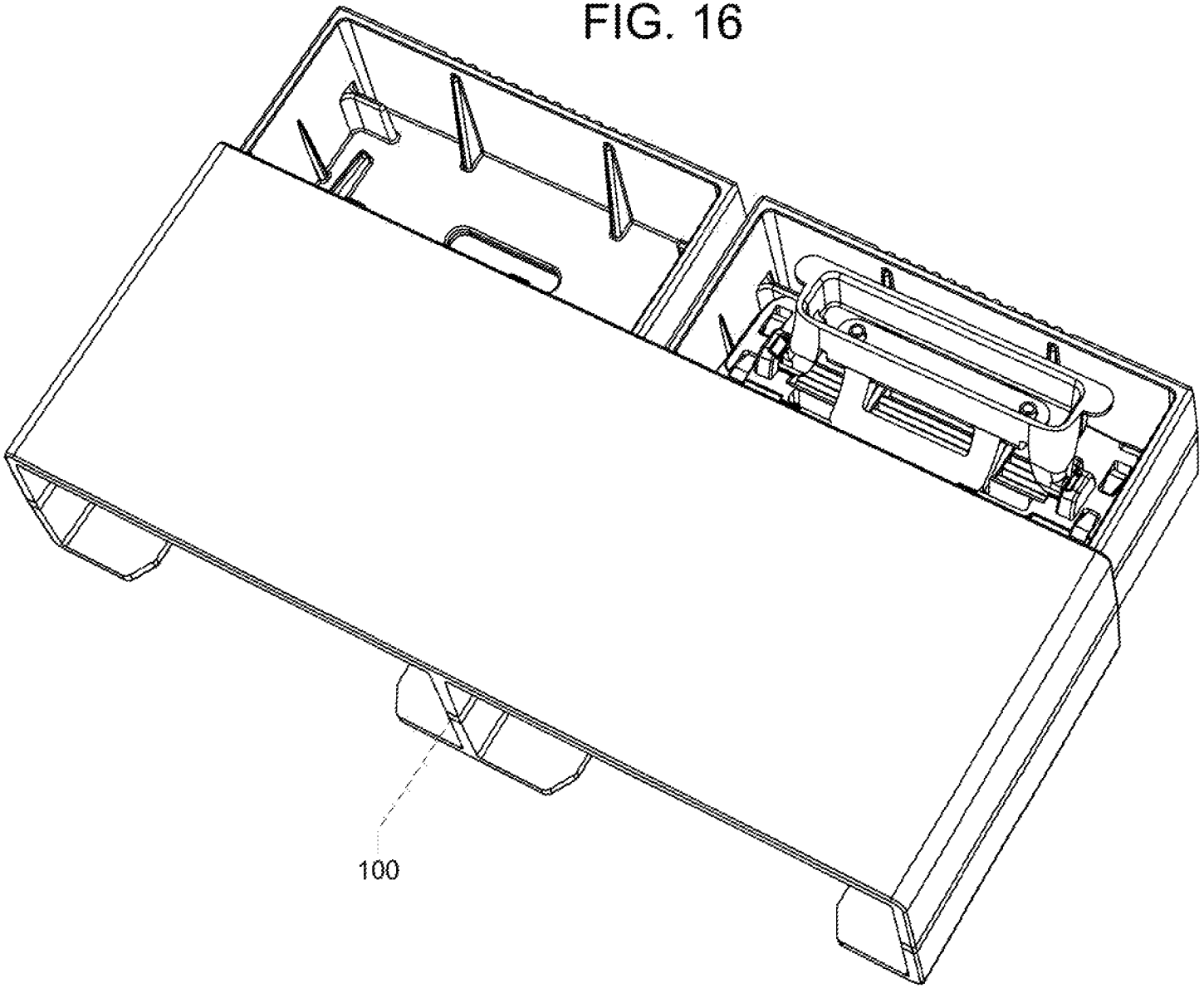
FIG. 16 is a top, perspective view of the device of FIG. 15, showing the two drawers in a first open position loaded with a shaving cartridge.

Referring to FIGS. 8, 11 and 12, raised features 36 hold the shaving assembly 12 in an elevated position with respect to the base of the cavities 50A, 50B creating an open area 57 between the blades and the bottom of the cavities. In addition, the raised features 36 help position the shaving assembly for handle insertion as seen in FIG. 16. This elevated position minimizes blade edge damage due to contact with the base of the cavity 50A, 50B. In addition, the elevated position created by the raised features 36 allows air to circulate more effectively around the shaving assembly 12 and allows for excess water to drain from the shaving assembly 12. The raised features 36 are positioned to contact the shaving assembly 12 in such a manner that the blades are untouched, preventing damage to the blade edges due to contact with surfaces. Each cavity 50A, 50B also includes a cutout 33 in the floor in the open area 57 under the blades. This cutout 33, which is in fluid communication with the open area 28 defined by the outer portion, serves as a portal for water and air, further enhancing water drainage and humidity equalization.

Figure 4:
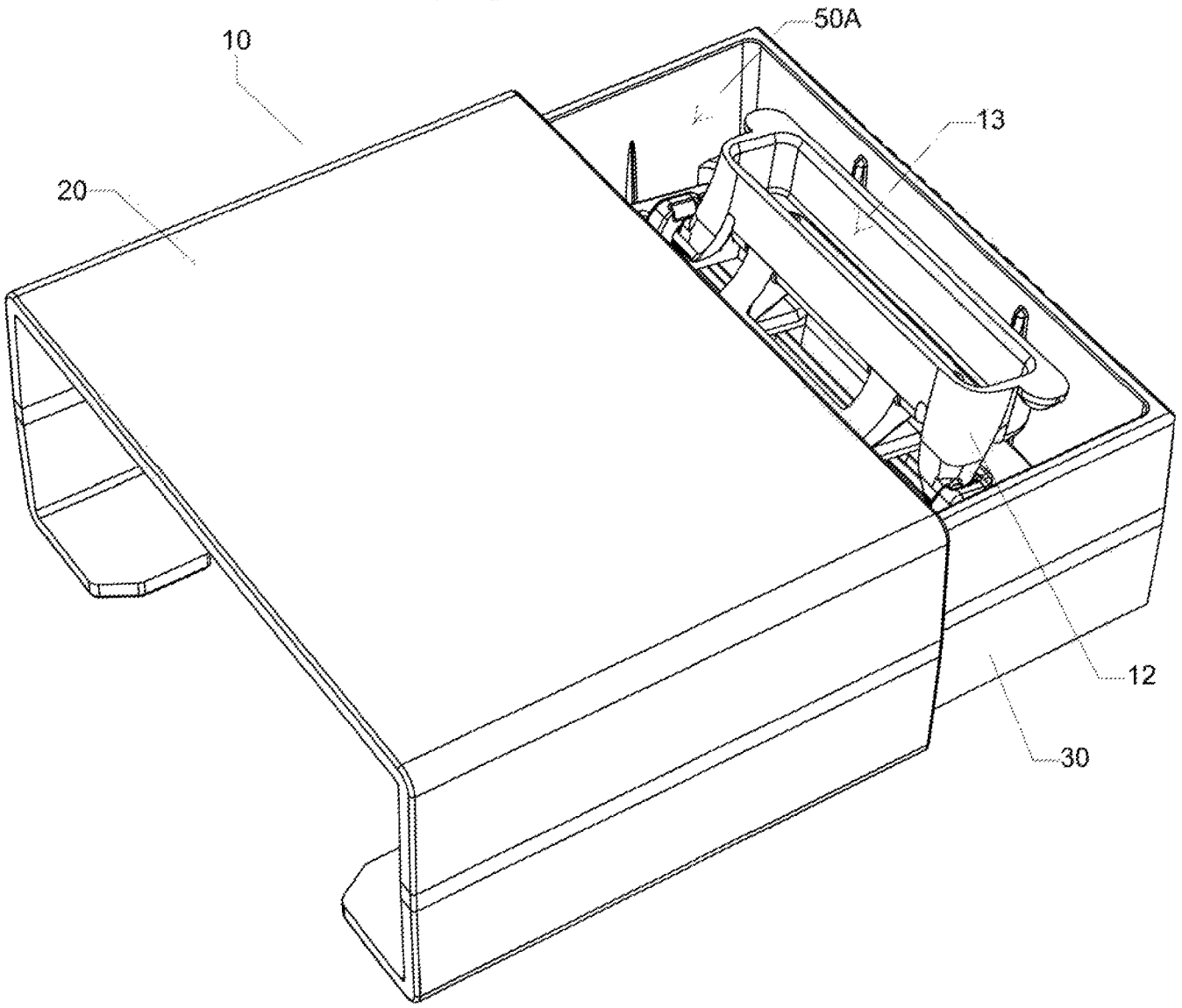
FIG. 4 is a perspective view of the device in a first open position loaded with a shaving cartridge.
Figure 6:
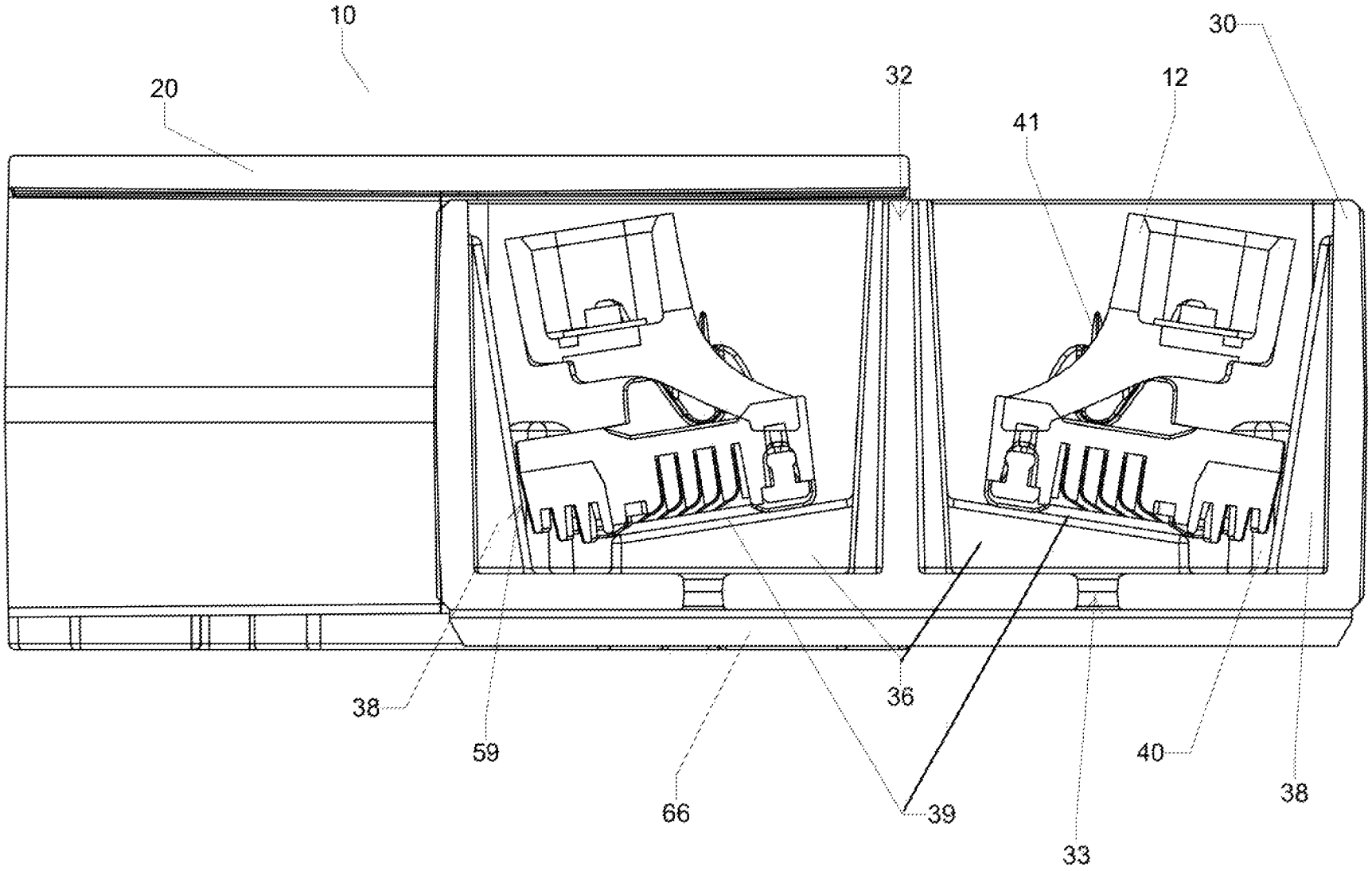
FIG. 6 is a sectional, planar view of the device loaded with two shaving cartridges in a first open position.
Figure 7:
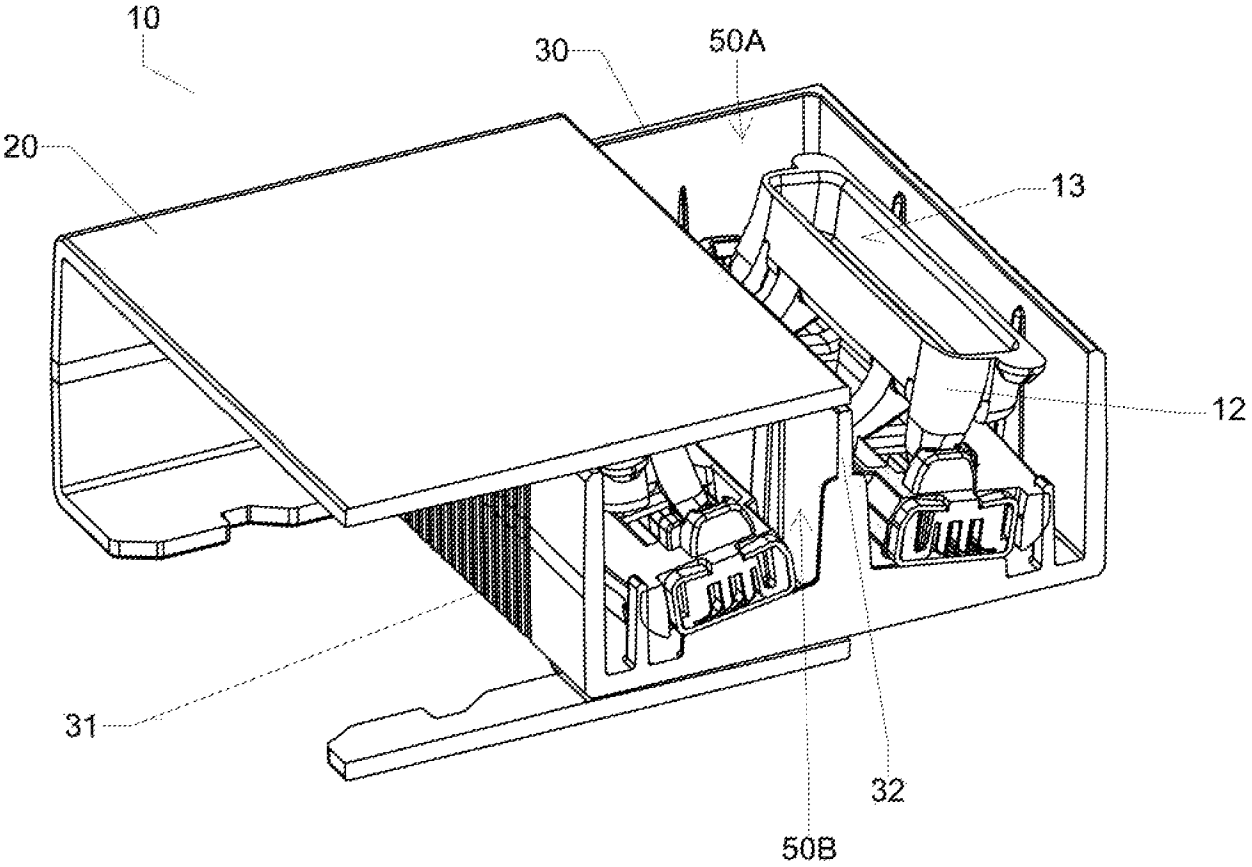
FIG. 7 is a sectional, perspective view of the device loaded with two shaving cartridges in a first open position.

Referring to FIGS. 4 and 6, the inner portion 30 is shown in a first open position with respect to the outer portion 20, in which a shaving assembly 12 is exposed. The consumer moves the inner portion from the closed position, shown in FIG. 1, to the open position shown in FIG. 4, e.g., by pushing against tactile element 31 while restraining movement of the outer portion 20.

When opening the container 10, the side walls 23, 23A (FIG. 2A) and bottom portions 24, 25 of the outer portion deflect slightly to allow the two pairs of stop tabs 70 discussed above (FIG. 2) to be disengaged from a corresponding pair of retaining recesses 28. The tabs 70 and recesses 28 are configured with angled shapes that limit unwanted movement, yet allow sliding engagement and disengagement. When the inner portion is moved in relation to the outer portion, the preload of the outer portion provides a return force so that edges 26, 27 reengage tabs 70.

Referring to FIGS. 4 and 5, to close the container 10 the user moves the inner portion 30 in the opposite direction, back into the outer portion 20. This movement is assisted by lead-in features 35, which are positioned on opposite edges of the base of outer portion 20. Tabs 70 are configured with angled surfaces that are complementary to the lead-in features 35. The angled surfaces of the tabs extend out from the guide rails 64, 66 of the inner portion 30. The guide rails 64, 66 are disposed on the bottom surface of the inner portion 30 and extend generally perpendicularly from the bottom surface.

Referring to FIG. 5, when closing the container 10, the lead-in features 35, which are angled in shape, engage the surfaces 72 of tabs 70, causing the bottom portions of the outer portion 20 to deflect outwardly and thus allowing tabs 70 to move into alignment with recesses 28, retaining the dispenser in its closed position. When the container 10 is in the closed position, as shown in FIG. 2, there are four tabs 70 which are engaged in four corresponding recesses 28. When the container 10 is in the open position, as shown in FIG. 6, only two tabs 70 are engaged in two corresponding recesses 28.

Referring to FIGS. 7, 8, 9, and 10, the container 10 can be positioned in two distinct open positions in each of which a single shaving assembly 12 is exposed in a proper loading position. The lead-in features 35, the recesses 28, and the tabs 70 work together in concert to create the two distinct open positions and the distinct closed position. In each of these positions, the engagement of the cooperating recesses and tabs serves to maintain the inner portion 30 in a stable, fixed position relative to the outer portion 20 until pressure is applied by the consumer.

Referring to FIGS. 2 and 5, the recesses 28 combined with the tabs 70 not only act to hold the inner portion 30 in the open and closed positions with respect to the outer portion 20, but also act as stops to prevent inadvertent ejection of the inner portion from the outer portion when opening the device. Thus, these complementary features prevent undesired dis-assembly and provide user feedback when clicking into the fully open positions.

The amount of force necessary to disengage the engagement between the retaining features (e.g., tabs and recesses), can be varied by altering the configuration of the retaining features. For example, in the alternate embodiment shown in FIGS. 19-21 the inner portion includes open areas 90, 92 adjacent each of the tabs that allow the tabs to more easily flex, tending to reduce the force required to open the container. Other features can be provided to increase the force required, e.g., the pretensioning described above with reference to FIG. 18.

The container 10 is designed to be opened and closed multiple times. This allows a used shaving assembly to be returned to the container, e.g. between uses or for safe disposal.

Referring to FIGS. 2A and 11, outer portion 20 has two distinct raised rails 22 that extend from inner surface 29. Rails 22 provide a bearing surface 55 of inner portion 30 that provides a sliding surface when moving the inner portion with respect to the outer portion. Furthermore, bearing surface 55 provides pivoting stability when the container is in the open position, limiting unwanted movement and/or pivoting between the inner portion 30 and outer portion 20 (FIG. 10). In some implementations, the force needed to open the container 10 with all four stops engaged is approximately between 100 g to 300 g. With two stops engaged, as when closing the container 10, the force would be approximately between 50 and 150 g. The force is measured using a linear force gauge to push on the center of the front wall of the inner portion while holding the outer portion in a fixed position until movement is achieved.

The container 10 can be made of any suitable material including, for example, polyethylene terephthalate (PET or PETE), high density (HD) PETE, thermoplastic polymer, polypropylene, oriented polypropylene, polyurethane, polystyrene, acrylonitrile butadiene styrene (ABS), polyvinyl chloride (PVC), polytetrafluoroethylene (PTFE), polyester, metal, synthetic rubber, natural rubber, silicone, nylon, polymer, wood, antibacterial or antimicrobial materials, insulating, thermal, other suitable sustainable or biodegradable materials, or any combination thereof.

OTHER EMBODIMENTS

A number of embodiments have been described. Nevertheless, it will be understood that various modifications may be made without departing from the spirit and scope of the disclosure.

For example, another embodiment could feature a container that is configured to hold and dispense other replaceable consumer products, e.g. toothbrush heads.

Alternate embodiments may feature alternative manners of inner and outer container deflection. For example, some embodiments may be configured so that just the outer container deflects when the inner container is moved between the open and closed positions. Other embodiments may be configured so that aspects of the inner container deflect when the inner container is moved between the open and closed positions. Further embodiments may be configured so that both the inner and outer container deflect in concert to provide the desired releasable retention interaction when moving the container from the closed position to the open position and visa versa.

Figure 15:
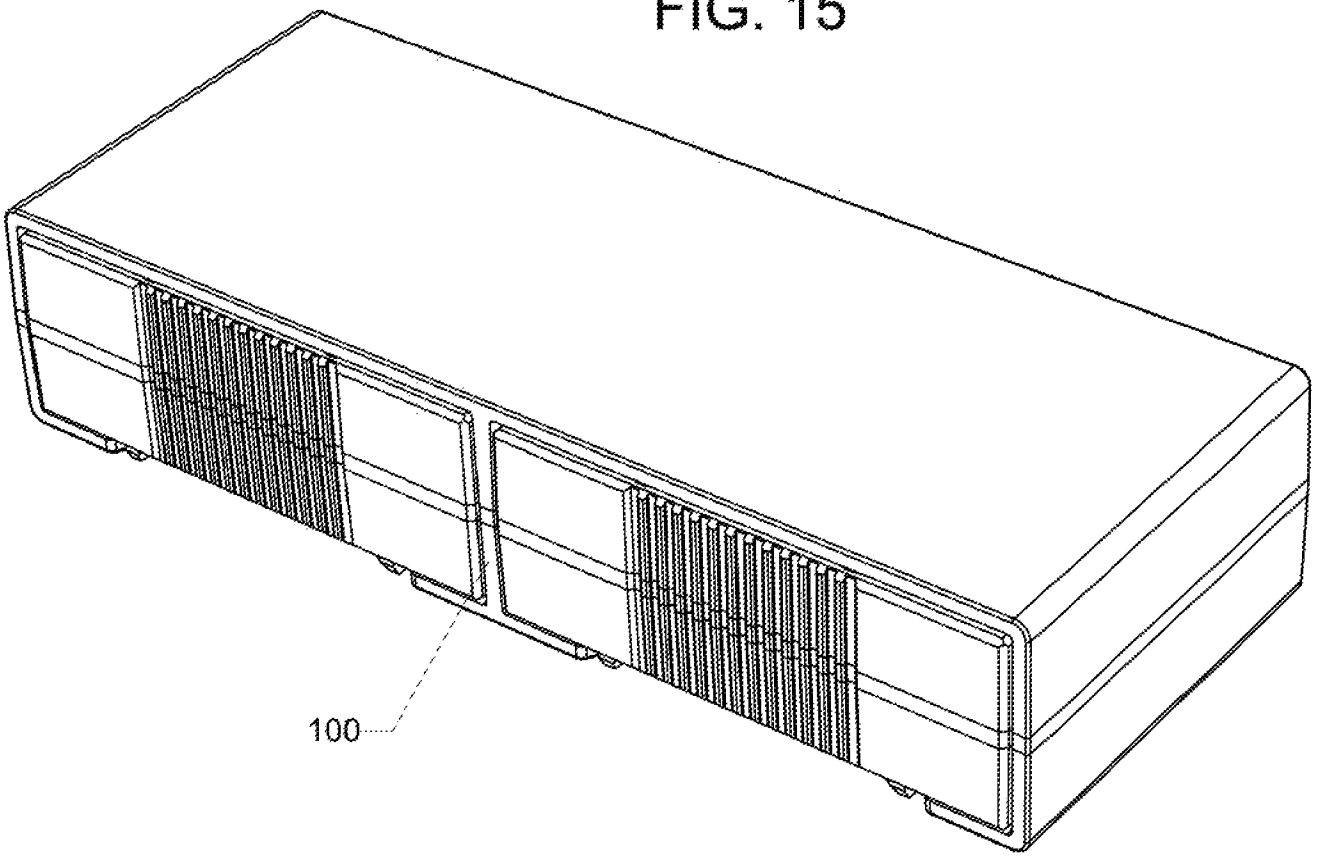
FIG. 15 is a top, perspective view of an alternate embodiment showing two drawers in the closed position.
Figure 17:
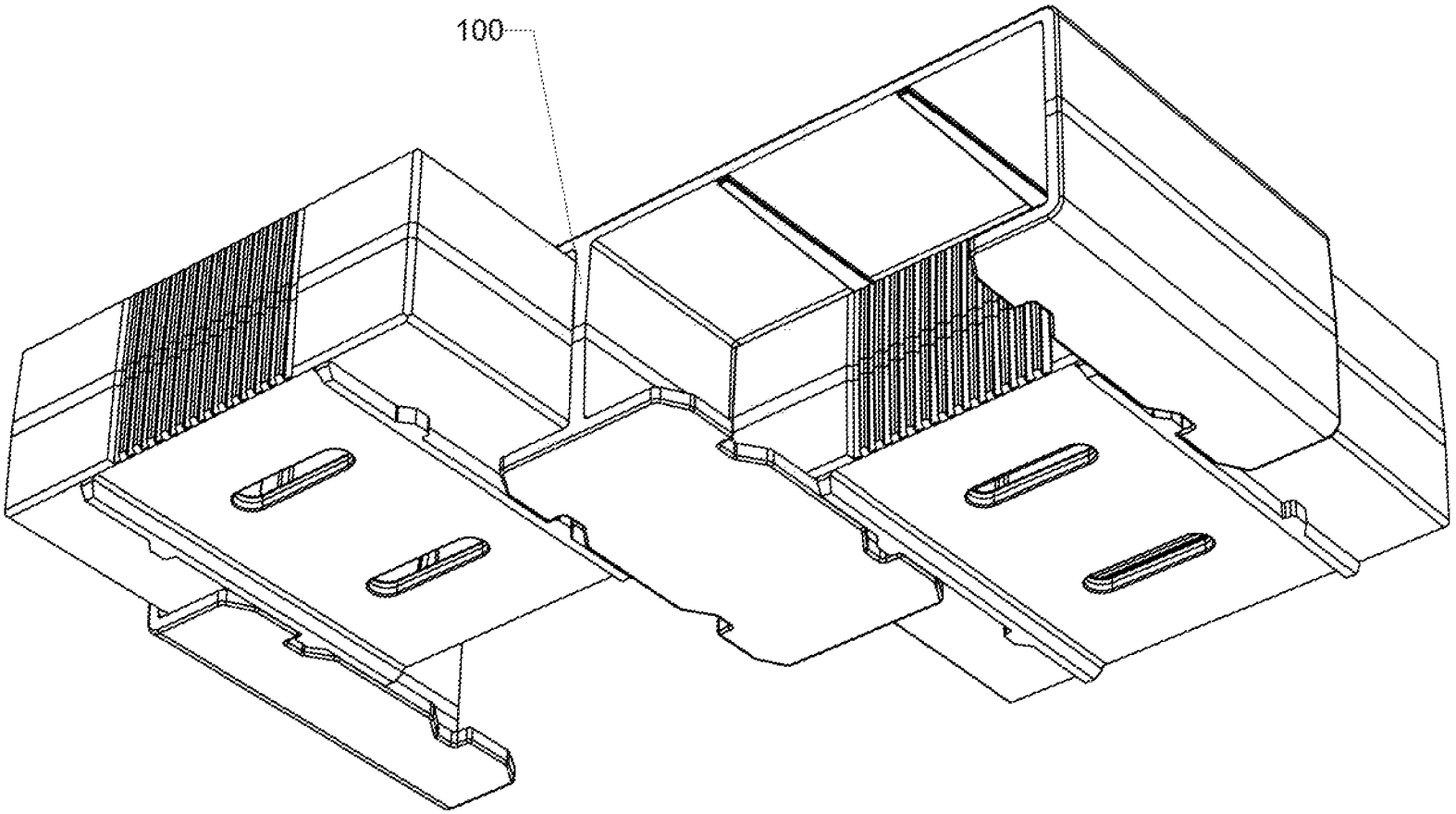
FIG. 17 is a bottom, perspective view of the device of FIG. 15, showing the two drawers in two different open positions.

Another embodiment could feature a container that is configured to accommodate a greater number of shaving assemblies, e.g. more than two. This could be accomplished in a variety of ways, e.g., positioning two or more drawers next to each other wherein each drawer is configured to hold two shaving assemblies, e.g., as disclosed in U.S. patent application Ser. No. 14/101,163 and shown herein in FIGS. 15-17. Referring to FIG. 15-17, the central wall 100 may be dimensioned differently from the side walls, e.g., the central wall may need have a greater wall thickness to ensure proper engagement and disengagement of the retaining features previously discussed. In this case, the tabs and recesses may be scaled or otherwise altered as needed to accommodate the reduced flexing of the central wall as compared to the side walls.

An alternate embodiment could feature a single drawer that is configured to hold more than two shaving assemblies, e.g. four shaving assemblies which are positioned in four separate compartments so that one pair of the shaving assemblies is oriented in the same direction while the other pair is oriented in the opposite direction. In addition, the container could be scaled to accommodate either larger or smaller dimensioned shaving assemblies. For example, shaving assemblies intended for used on large surface area body parts, i.e. the legs, chest, back, etc.

Figure 19:
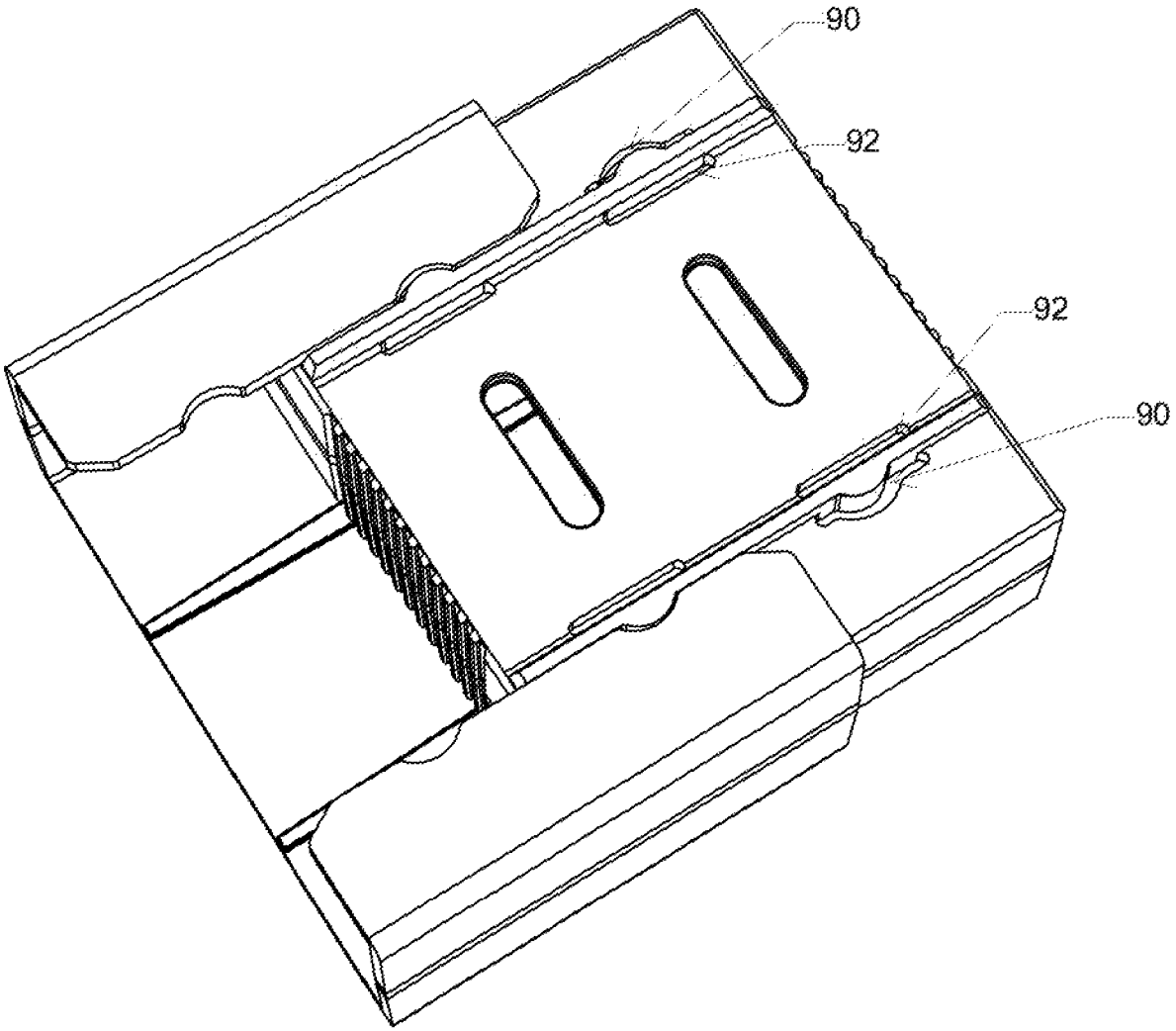
FIG. 19 is a perspective view from below of an alternate embodiment of the device.
Figure 20:
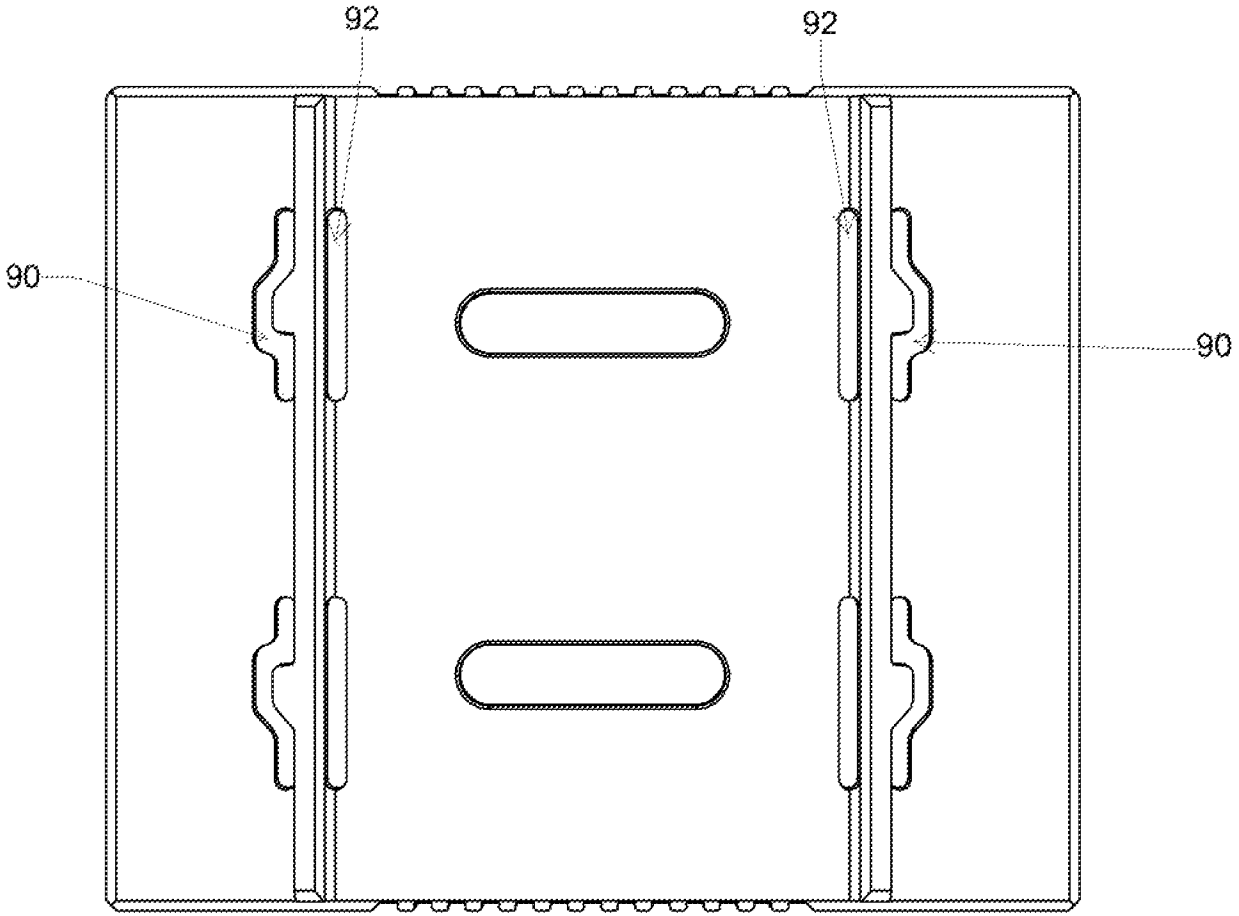
FIG. 20 is a bottom plan view of the inner portion of the device shown in FIG. 19.
Figure 21:
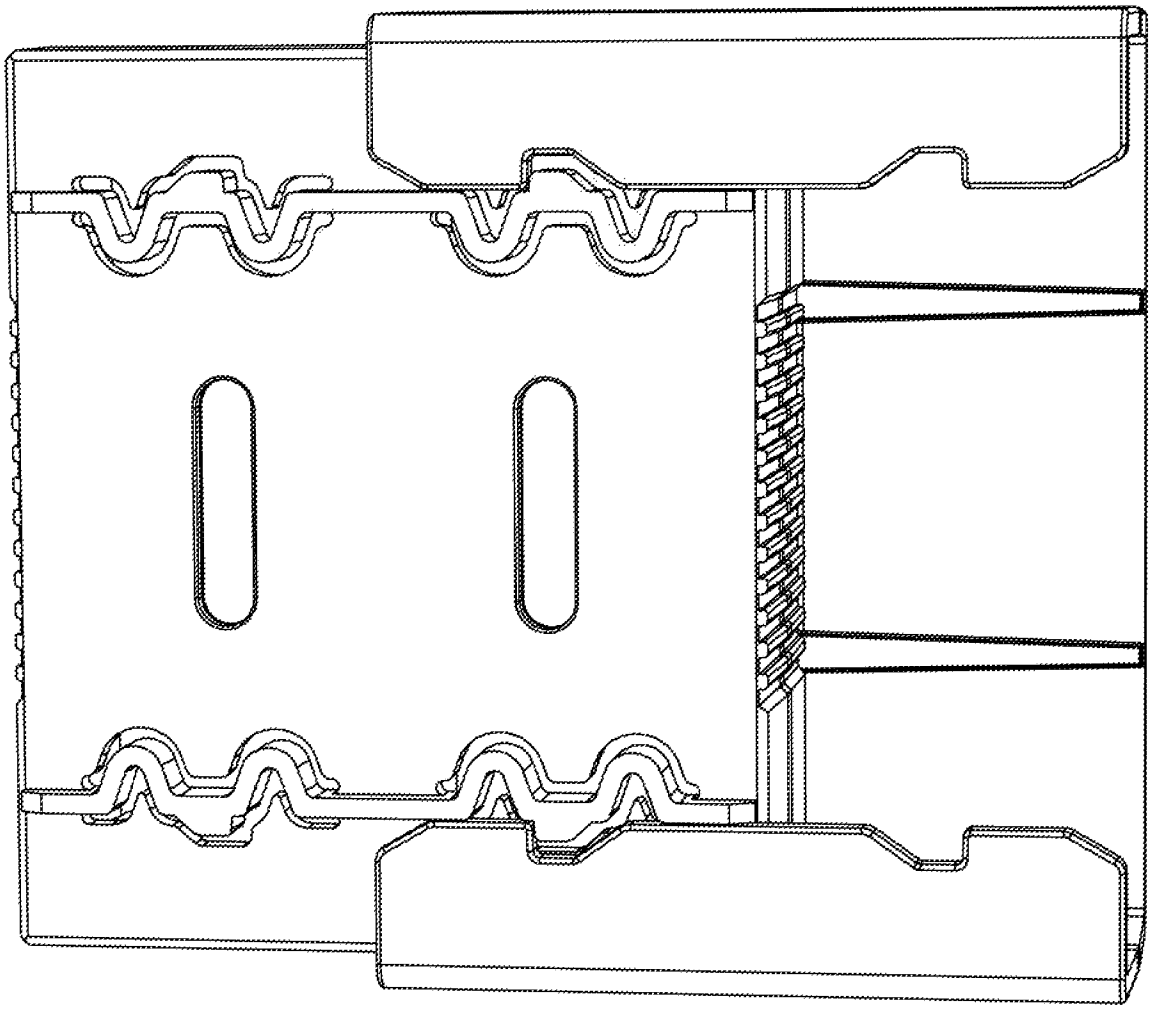
FIG. 21 is a perspective view from below of another alternate embodiment of the device.

Another embodiment could feature differently configured corresponding retaining features. For instance, the retaining features could be designed to be any complementary shape that would provide for the desired releasable locking interaction. For example, the retaining features could be spherical, arced, wave-shaped or any complementary shape configuration that provides the desired interaction. Examples of alternative complementary retaining features are shown in FIGS. 19-21. Referring to FIG. 21, the retaining features are configured to function as springs, such that they return to a predetermined configuration after deflection, e.g. when the inner container is moved between the open configuration and the closed configuration, or visa versa.

An alternate embodiment could feature differently configured lead-in features to releasably secure the inner container when accessing a cartridge so that the device does not inadvertently disassemble, i.e. the inner portion does not separate from the outer container.

In addition, another embodiment could feature more or fewer retaining features.

Another embodiment could feature compartments that are of different sizes. The inner compartments could be configured to hold two differently sized shaving assemblies. For example, one cartridge could be smaller, intended for facial use, while the other cartridge could be larger, intended for use on larger, surface area body features, i.e. the chest, back, etc.

In another embodiment, the container could include only a single compartment, and/or contain only a single shaving assembly when sold. For example, the shaving system would be offered to the consumer with a replaceable shaving assembly already attached to the handle and a single, replacement shaving assembly would be housed in the container. A single-compartment container could also be used with larger shaving assemblies, e.g., for female or body shaving. In some cases, these single compartment containers would closely resemble the two compartment containers discussed above in terms of the arrangement of complementary stop features. Generally, so that the two open positions described above could still be provided, the inner portion of a single compartment or single shaving assembly container would include a region that would occupy approximately the same space as the second compartment in the containers discussed above (e.g., an empty compartment for receiving a used cartridge, or a solid "blank" region.)

Another embodiment of the inner portion could feature alternatively configured raised elements to ensure proper positioning of the shaving assembly while in transit, during storage or during engagement with a handle.

In some cases, the lead-in features may be omitted, made smaller or altered in another manner if they are not necessary for initial assembly of the inner portion into the outer portion.

Accordingly, other embodiments are within the scope of the following claims.

What is claimed is:

1. A method comprising:

(a) providing a device for storing shaving assemblies, the device including a generally C-shaped outer container, and a sectioned inner container defining at least two compartments, each compartment containing a shaving assembly, wherein each compartment of the inner container includes angled positioning features disposed at a fixed angle relative to a floor of the compartment and configured to position the shaving assembly within the compartment for interaction of an opening in an interface element of the shaving assembly with a razor handle during mounting of the shaving assembly on the handle, and wherein the angled positioning features in the compartments position the openings of the interface elements of at least two of the shaving assemblies facing in opposite directions, the inner container being disposed within the outer container and being movable relative to the outer container between a closed position, a first open position in which one of the shaving assemblies is exposed, and a second open position in which the other shaving assembly is exposed;

(b) moving the inner container from its closed position into its first or second position to expose one or the other of the shaving assemblies; and (c) mounting the exposed shaving assembly on the razor handle.

2. The method of claim 1 further comprising inserting a used shaving assembly into one of the compartments and moving the inner container to the closed position.

3. The method of claim 1 further comprising opening and closing the device multiple times to remove the shaving assemblies.

4. The method of claim 1 wherein moving the inner container comprises sliding the inner container along raised rails that extend from an inner surface of the outer container.

5. The method of claim 1 further comprising providing the device with retaining features that releasably retain the inner container in the closed position, first open position and second open position.

6. The method of claim 5 wherein moving the inner container comprises applying a sufficient force to deflect side walls and bottom portions of the C-shaped outer container thereby disengaging the retaining features.

7. The method of claim 6 wherein moving the inner container from its closed position to one of its open positions comprises applying a force of from about 100 g to about 300 g to the outer container.

8. The method of claim 1 wherein mounting the shaving assembly on the handle comprises inserting an appendage on the razor handle into the opening in the interface element of the shaving assembly, and using magnetic force to attach the shaving assembly to the handle.

* * * * *